US012280294B2

(12) United States Patent
Ashby et al.

(10) Patent No.: US 12,280,294 B2
(45) Date of Patent: Apr. 22, 2025

(54) MAGNETIC CLUTCH FOR A PEDALED DRIVETRAIN

(71) Applicant: iFIT Inc., Logan, UT (US)

(72) Inventors: Darren C. Ashby, Richmond, UT (US); Benjamin Browning, Logan, UT (US)

(73) Assignee: iFIT Inc., Logan, UT (US)

( * ) Notice: Subject to any disclaimer, the term of this patent is extended or adjusted under 35 U.S.C. 154(b) by 244 days.

(21) Appl. No.: 17/966,393

(22) Filed: Oct. 14, 2022

(65) Prior Publication Data

US 2023/0122235 A1 Apr. 20, 2023

Related U.S. Application Data

(60) Provisional application No. 63/256,520, filed on Oct. 15, 2021.

(51) Int. Cl.
*A63B 22/06* (2006.01)
*A63B 21/22* (2006.01)

(52) U.S. Cl.
CPC ..... *A63B 22/0605* (2013.01); *A63B 21/225* (2013.01); *A63B 2022/0611* (2013.01)

(58) Field of Classification Search
CPC ..... A63B 22/0605; A63B 21/225; A63B 2022/0611; A63B 2220/808; A63B 2225/50; A63B 21/0051; F16D 41/24; F16D 48/06; F16D 41/26; F16D 28/00; F16D 41/36; F16D 27/118; B60B 27/023; B60B 27/0031; B60B 27/047; B62M 9/10; B60Y 2200/13
See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang et al. |
| 4,023,795 | A | 5/1977 | Pauls |
| 4,300,760 | A | 11/1981 | Bobroff |
| D286,311 | S | 10/1986 | Martinell et al. |
| 4,681,318 | A | 7/1987 | Lay |
| 4,684,126 | A | 8/1987 | Dalebout et al. |
| 4,728,102 | A | 3/1988 | Pauls |
| 4,750,736 | A | 6/1988 | Watterson |
| 4,796,881 | A | 1/1989 | Watterson |

(Continued)

OTHER PUBLICATIONS

XtremeOPE.com, "PTO Clutch for John Deere—AM100979", Originally Accessed From https://xtremeope.com/p/xtreme-replacement-clutch-for-replacement-for-john-deere-am 100979/, on or around Jun. 28, 2021, 5 pages.

(Continued)

*Primary Examiner* — Megan Anderson
*Assistant Examiner* — Andrew M Kobylarz
(74) *Attorney, Agent, or Firm* — Holland & Hart LLP

(57) ABSTRACT

A magnetic clutch transitions a drivetrain or flywheel between a freewheel or unlocked mode or configuration and a locked or fixed gear mode or configuration. The magnetic clutch includes a rotor rotationally fixed to the pedals of the drivetrain. An armature is connected to the flywheel. A field coil generates a magnetic field which causes the armature to move to the flywheel. Friction between the armature and the rotor rotationally fixes the flywheel to the rotor.

20 Claims, 10 Drawing Sheets

(56) References Cited

U.S. PATENT DOCUMENTS 4,813,667 A 3/1989 Watterson
4,830,371 A 5/1989 Lay
4,844,451 A 7/1989 Bersonnet et al.
4,850,585 A 7/1989 Dalebout et al.
D304,849 S 11/1989 Watterson
4,880,225 A 11/1989 Lucas et al.
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.

(56) References Cited

U.S. PATENT DOCUMENTS

D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,717,280 B1 * 4/2004 Bienville ..... B62M 6/90 290/1 R
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,029,415 B2 10/2011 Ashby et al.
8,033,960 B1 10/2011 Dalebout et al.
D650,451 S 12/2011 Olson et al.

(56) References Cited

U.S. PATENT DOCUMENTS

D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson et al.
D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,636,567 B2 5/2017 Brammer et al.
9,675,839 B2 6/2017 Dalebout et al.
9,682,307 B2 6/2017 Dalebout
9,694,234 B2 7/2017 Dalebout et al.
9,694,242 B2 7/2017 Ashby et al.
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 10/2017 Smith et al.
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
D868,909 S 12/2019 Cutler et al.
10,492,519 B2 12/2019 Capell et al.
10,493,349 B2 12/2019 Watterson
10,500,473 B2 12/2019 Watterson
10,537,764 B2 1/2020 Smith et al.

(56) References Cited

U.S. PATENT DOCUMENTS 10,543,395 B2 1/2020 Powell et al.
10,561,877 B2 2/2020 Workman
10,561,893 B2 2/2020 Chatterton et al.
10,561,894 B2 2/2020 Dalebout et al.
10,569,121 B2 2/2020 Watterson
10,569,123 B2 2/2020 Hochstrasser et al.
10,625,114 B2 4/2020 Ercanbrack
10,625,137 B2 4/2020 Dalebout et al.
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,786,706 B2 9/2020 Smith
10,864,407 B2 12/2020 Watterson et al.
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,187,285 B2 11/2021 Wrobel
11,298,577 B2 4/2022 Watterson
11,311,765 B2 * 4/2022 Cragg ..... A63B 21/0056
11,326,673 B2 5/2022 Buchanan
11,338,169 B2 5/2022 Dalebout et al.
11,338,175 B2 5/2022 Watterson et al.
11,426,633 B2 8/2022 Watterson et al.
11,451,108 B2 9/2022 Tinney
11,452,903 B2 9/2022 Watterson
11,511,152 B2 11/2022 Powell et al.
11,534,651 B2 12/2022 Ercanbrack et al.
11,534,654 B2 12/2022 Silcock et al.
11,534,655 B2 12/2022 Dalebout et al.
11,565,148 B2 1/2023 Dalebout et al.
11,596,830 B2 3/2023 Dalebout et al.
11,642,564 B2 5/2023 Watterson
11,673,036 B2 6/2023 Dalebout et al.
11,680,611 B2 6/2023 Wrobel
11,700,905 B2 7/2023 Ashby et al.
11,708,874 B2 7/2023 Wrobel
2005/0140113 A1 * 6/2005 Kokatsu ..... A63B 22/0605 280/205
2008/0051256 A1 2/2008 Ashby et al.
2009/0255774 A1 * 10/2009 Hsu ..... F16D 41/185 192/64
2012/0285785 A1 * 11/2012 Tho ..... F16D 27/01 192/64
2014/0062164 A1 * 3/2014 Spahr ..... B60B 27/047 301/6.9
2015/0251055 A1 9/2015 Ashby
2016/0058335 A1 3/2016 Ashby
2016/0346595 A1 12/2016 Dalebout et al.
2017/0124912 A1 5/2017 Ashby et al.
2017/0193578 A1 7/2017 Watterson
2017/0246904 A1 * 8/2017 Emura ..... F16D 41/24
2017/0266489 A1 9/2017 Douglass et al.
2017/0270820 A1 9/2017 Ashby et al.
2018/0085630 A1 3/2018 Capell et al.
2018/0099116 A1 4/2018 Ashby
2018/0099180 A1 4/2018 Wilkinson
2018/0111034 A1 4/2018 Watterson
2019/0113086 A1 * 4/2019 Rosser ..... F16D 41/069
2019/0210690 A1 * 7/2019 Huang ..... B62K 19/34
2019/0223612 A1 7/2019 Watterson et al.
2019/0269971 A1 9/2019 Capell et al.
2020/0009417 A1 1/2020 Dalebout
2020/0391069 A1 8/2020 Olson et al.
2020/0368575 A1 11/2020 Hays et al.
2021/0001177 A1 1/2021 Smith
2021/0046353 A1 2/2021 Dalebout et al.
2021/0106899 A1 4/2021 Willardson et al.
2021/0110910 A1 4/2021 Ostler et al.
2021/0146221 A1 5/2021 Dalebout et al.
2021/0155038 A1 * 5/2021 Miles ..... B60B 27/023
2021/0213331 A1 7/2021 Watterson
2021/0268336 A1 9/2021 Watterson et al.
2021/0291013 A1 9/2021 Nascimento
2021/0299518 A1 9/2021 Brammer et al.
2021/0299542 A1 9/2021 Brammer et al.
2021/0339079 A1 11/2021 Dalebout et al.
2022/0062685 A1 3/2022 Ashby et al.
2022/0074455 A1 * 3/2022 Wrobel ..... F16D 41/30
2022/0104992 A1 4/2022 Ashby
2022/0212052 A1 7/2022 Ercanbrack et al.
2022/0223254 A1 * 7/2022 Foley ..... A63B 24/0062
2022/0241649 A1 8/2022 Ashby
2022/0241665 A1 8/2022 Dalebout et al.
2022/0241668 A1 8/2022 Willardson et al.
2022/0249912 A1 8/2022 Watterson et al.
2022/0257994 A1 8/2022 Smith
2022/0258007 A1 8/2022 Watterson et al.
2022/0258008 A1 8/2022 Watterson et al.
2022/0266085 A1 8/2022 Dalebout et al.
2022/0280857 A1 9/2022 Watterson
2022/0309042 A1 9/2022 Archer
2022/0314078 A1 10/2022 Watterson et al.
2022/0323827 A1 10/2022 Watterson et al.
2022/0339493 A1 10/2022 Larsen
2022/0339520 A1 10/2022 Toth
2022/0342969 A1 10/2022 Watterson et al.
2022/0347516 A1 11/2022 Taylor
2022/0347548 A1 11/2022 Watterson
2022/0362613 A1 11/2022 Watterson et al.
2022/0362624 A1 11/2022 Dalebout
2022/0395729 A1 12/2022 Toth
2023/0039903 A1 2/2023 Brammer et al.
2023/0054845 A1 2/2023 Smith
2023/0122235 A1 4/2023 Ashby et al.
2023/0128721 A1 4/2023 Plummer
2023/0158358 A1 5/2023 Ercanbrack et al.
2023/0181993 A1 6/2023 Taylor et al.
2023/0191189 A1 6/2023 Taylor et al.
2023/0191197 A1 6/2023 Ashby
2023/0218975 A1 7/2023 Toles et al.
2023/0226401 A1 7/2023 Watterson

OTHER PUBLICATIONS

XtremeOPE.com, "PTO Clutch for Cub Cadet 1050, 1204, 1210, 1211, 1535, 1541, 1710, 1806, 1810 , 1811, 1812", Originally Accessed From https://xtremeope.com/p/pto-clutch-for-cub-cadet-1050-1204-1210-1211-1535-1541-1710-1806-1810-1811-1812/, on or around Jun. 28, 2021, 6 pages.

XtremeOPE.com, "PTO Clutch for John Deere—AM122969", Originally Accessed From https://xtremeope.com/p/xtreme-replacement-clutch-for-replacement-for-john-deere-am 122969/, on or around Jun. 28, 2021, 7 pages.

Amazon.com, "UAC CL 1620C A/C Compressor Clutch", Originally Accessed From https://www.amazon.com/gp/product/B003R7LT1M/ref=ox_sc_act_title_1?smid=ATVPDKIKXODER&psc=1, on or around Jun. 28, 2021, 6 pages.

Amazon.com, "FKG AC Compressor Clutch Assembly Repair Kit CO 10835C 8832004060 Fit for 2005-2015 Toyota Tacoma 2.7L, 2005-2015 Toyota Tacoma 4L", Originally Accessed From https://www.amazon.com/gp/product/B09221YYJ8/ref-ox_sc_act_title_2?smid=A352SKC43WMIWM&psc=1, on or around Jun. 28, 2021, 5 pages.

U.S. Appl. No. 17/066,485, filed Oct. 9, 2020, Weston et al.

U.S. Appl. No. 17/739,819, filed May 9, 2022, Buchanan.

(56) References Cited

OTHER PUBLICATIONS

U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/103,221, filed Jan. 30, 2023, Dalebout et al.
U.S. Appl. No. 18/114,758, filed Feb. 27, 2023, Cutler et al.
U.S. Appl. No. 18/117,263, filed Mar. 3, 2023, Smith et al.
U.S. Appl. No. 18/123,026, filed Mar. 17, 2023, Silcock et al.
U.S. Appl. No. 18/132,277, filed Apr. 7, 2023, Vasquez et al.
U.S. Appl. No. 18/136,535, filed Apr. 19, 2023, Ashby et al.
U.S. Appl. No. 18/141,872, filed May 1, 2023, Ashby et al.
U.S. Appl. No. 18/205,299, filed Jun. 2, 2023, Wrobel.
U.S. Appl. No. 18/207,512, filed Jun. 8, 2023, Chuang.
U.S. Appl. No. 18/210,505, filed Jun. 15, 2023, Nielsen et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.

* cited by examiner

MAGNETIC CLUTCH FOR A PEDALED DRIVETRAIN

CROSS-REFERENCE TO RELATED APPLICATIONS

This application claims priority to and benefit of U.S. Provisional Patent Application No. 63/256,520, filed Oct. 15, 2021, which is incorporated by reference in its entirety.

BACKGROUND

Cyclic motion can be very efficient power output for transportation and/or movement and is used in bicycles, tricycles, and other land-based vehicles; pedal boats and other water vehicles; and ultralight aircraft, microlight aircraft, and other aerial vehicles. Similarly, the biomechanics of the cyclic motion may produce lower impact on a user, reducing the risk of joint injury, skeletal injury, muscle injury, or combinations thereof. In contrast to other exercises such as running, cyclic motion may avoid repeated impacts on the body. Therefore, cyclic motion is a common exercise technique for fitness and/or rehabilitation. For example, elliptical running machines, stationary bicycles, handcycles, and other cyclic and/or rotary motion machines may provide resistance training or endurance training with little or no impacts upon the user's body.

A human-powered cycling system may have a drivetrain to direct energy from a user to a wheel, flywheel, or other rotating component of the cycling system. The drivetrain may transmit energy from the user to a rotational axis in only one direction about the rotational axis, or the drivetrain may transmit energy from the user to the rotational axis in both directions about the rotational axis. For example, many conventional bicycles include a freewheel hub in the rear of the bicycle that may receive energy from a drive mechanism, such as a chain, to rotate the rear wheel in a forward direction and propel the bicycle. Rearward rotation of the drive mechanism relative to the wheel may be not transferred. For example, "backpedaling" on a bicycle with a freewheel hub may result in little or no energy transmitted to the rear wheel. Additionally, the freewheel hub may freely rotate in the forward direction relative to the drive mechanism (i.e., rotate in the forward direction faster than the drive mechanism), allowing the bicycle to roll forward faster than a user pedals the drive mechanism.

Some bicycles may have a direct drive or "fixed gear" drivetrain that allows a user to slow a forward motion and/or propel the bicycle in a rearward direction by backpedaling. In such bicycles, the direct drive may couple the drive mechanism to the wheel, such that rotational movement of the drive mechanism in either direction is transmitted to the wheel and rotational movement of the wheel in either direction is similarly transmitted to the drive mechanism.

Conventional exercise devices utilize either a freewheel hub to simulate a conventional bicycle experience for exercise and/or training purposes or a direct drive to increase the energy requirements from the user and provide a more intense training experience.

BRIEF SUMMARY

In some embodiments, a pedaled drive train includes a drive mechanism and a flywheel having a rotational axis. A hub connects the drive mechanism to the flywheel in a first rotational direction around the rotational axis. A magnetic clutch is connected to the drive mechanism and the hub. The magnetic clutch moves the hub between a locked state and an unlocked state based on an application of an electric current.

In other embodiments, a cycling system includes handlebars supported by a frame. A flywheel having a rotational axis is connected to the frame. A drivetrain is supported by the frame and rotationally connected to the flywheel. The drivetrain includes a freewheel hub rotationally connected to the flywheel in a first direction. A pedal is connected to the freewheel hub. A rotation of the pedal causes a rotation of the freewheel. The drivetrain includes a magnetic clutch. The magnetic clutch includes a field coil that is configured to produce a magnetic field upon application of an electric current. The magnetic clutch includes a rotor rotationally fixed to the pedal. An armature is rotationally fixed to the flywheel and axially movable along the rotational axis between a locked position and an unlocked position based on a presence of the magnetic field. In the locked position, the armature is rotationally fixed to the rotor.

In yet other embodiments, a method of transmitting torque in a pedaled drivetrain includes operating a flywheel in a freewheel mode. In the freewheel mode, a first torque applied by a pedal in a first direction is transferred to the flywheel and a second torque applied by the pedal in a second direction is not transferred to the flywheel. A magnetic clutch is engaged to move an armature rotationally fixed to the flywheel into contact with a rotor rotationally fixed to the pedal. The flywheel is then operated in a fixed gear mode. In the fixed gear mode, the first torque and the second torque are transferred to the flywheel.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 4-1 is a side schematic representation of a drivetrain and wheel in an unlocked state, according to at least one embodiment of the present disclosure;

FIG. 4-2 is a side schematic representation of the embodiment of a drivetrain and wheel of FIG. 4-1 in an unlocked state with the wheel rotating without an input force from the drivetrain;

FIG. 6-1 is a perspective view of a representation of a magnetic clutch;

FIG. 6-2 is an exploded view of the magnetic clutch of FIG. 6-1;

FIG. 6-3 is a cross-sectional view of the magnetic clutch of FIG. 6-1;

FIG. 6-4 is a close-up cross-sectional view of the upper half of the magnetic clutch of FIG. 6-3.

DETAILED DESCRIPTION

This disclosure generally relates to devices, systems, and methods for transferring a flywheel on an exercise device between a fixed gear and a freewheel mode. The exercise device may include a magnetic clutch as part of the drivetrain. The magnetic clutch may be activated or engaged to rotationally fix the flywheel to the pedals in the drivetrain. The magnetic clutch includes an armature and a field coil. When electrified, the field coil generates a magnetic field that attracts the armature to a rotor. When the armature is in contact with the rotor, the flywheel is rotationally fixed to the pedal. This may help to allow the user to easily and effectively change between the freewheel mode and the fixed gear mode. In other embodiments, the field coil and the armature may be reversed such that activation of the field coil disconnects the flywheel rotationally from the pedal.

Figure 1:
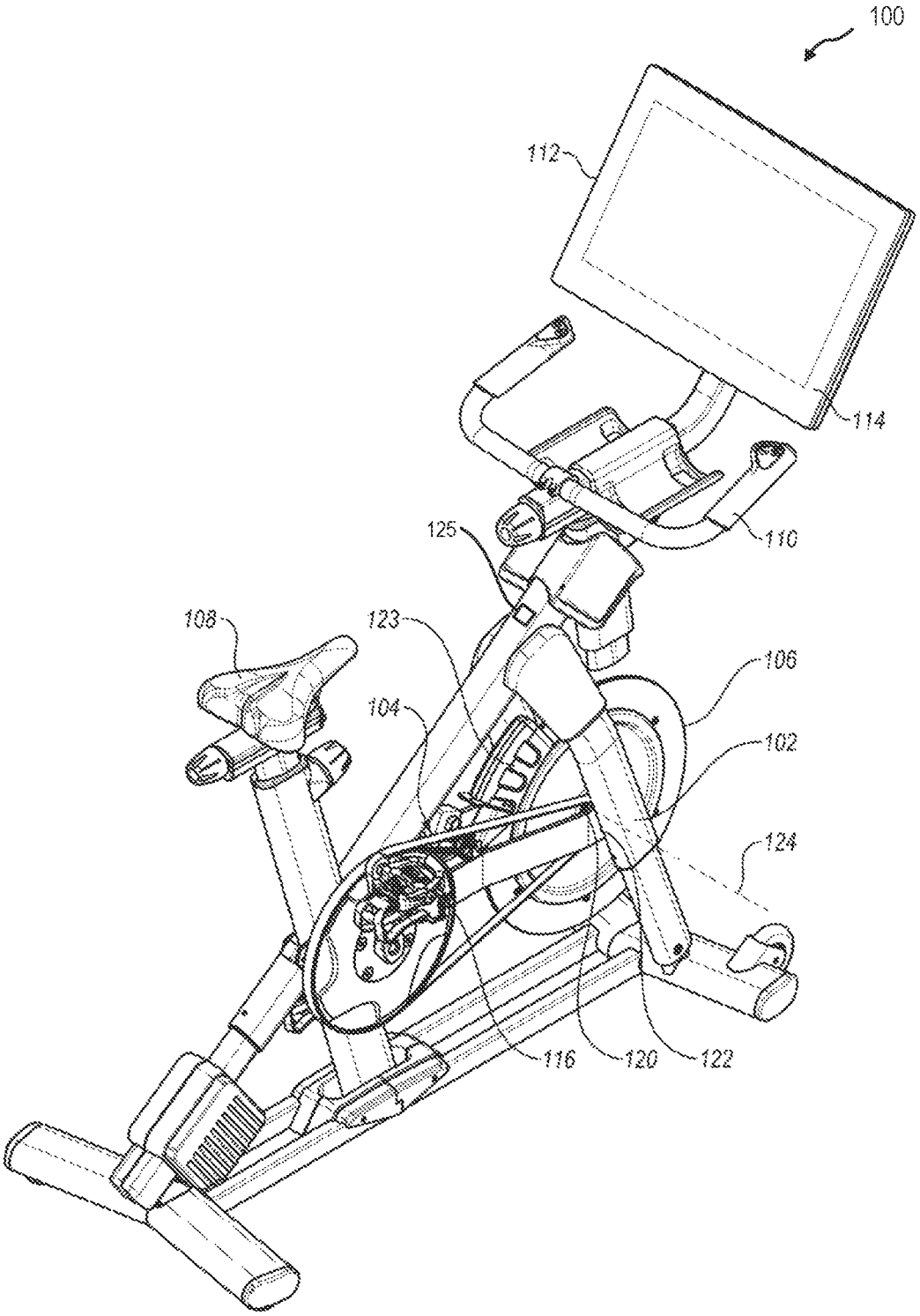
FIG. 1 is a perspective view of an exercise bicycle, according to at least one embodiment of the present disclosure.
Figure 2:
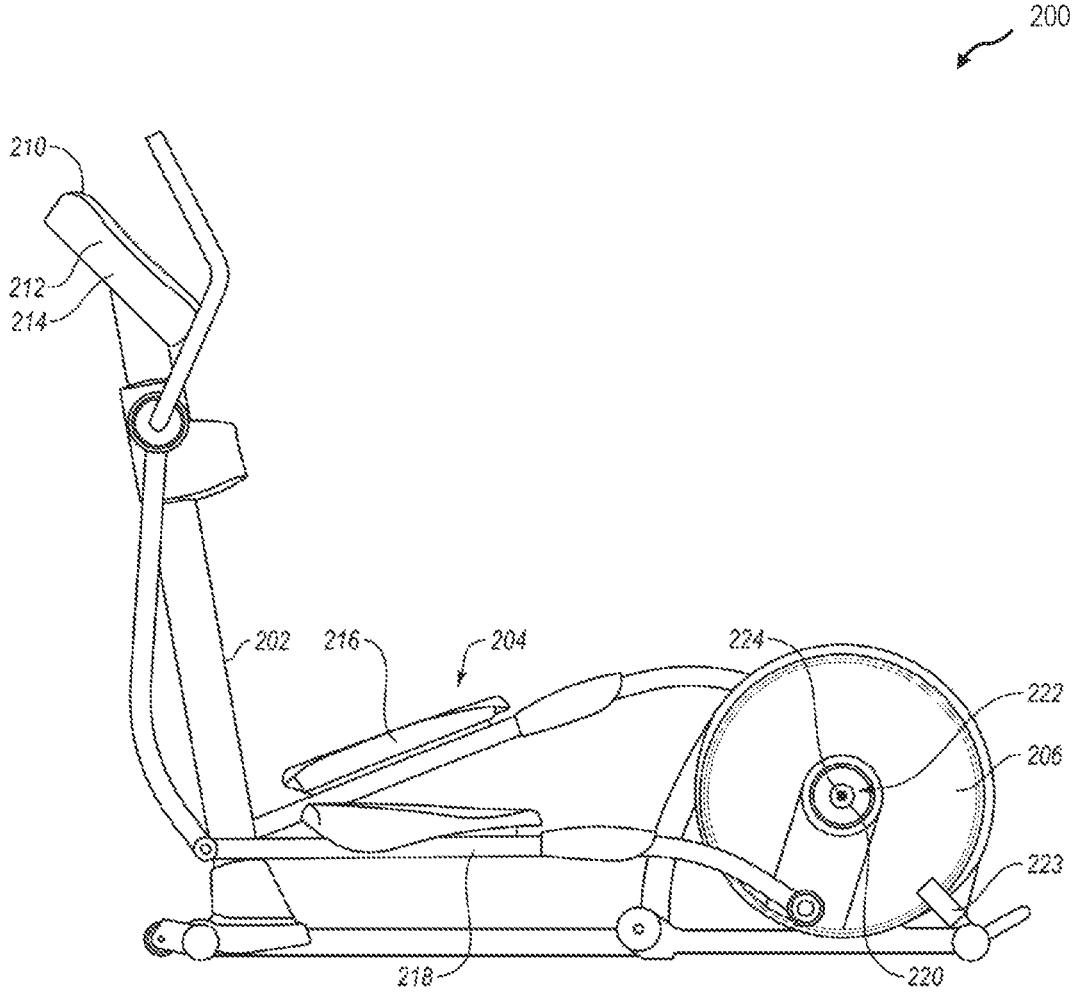
FIG. 2 is a side view of an elliptical trainer, according to at least one embodiment of the present disclosure.
Figure 3:
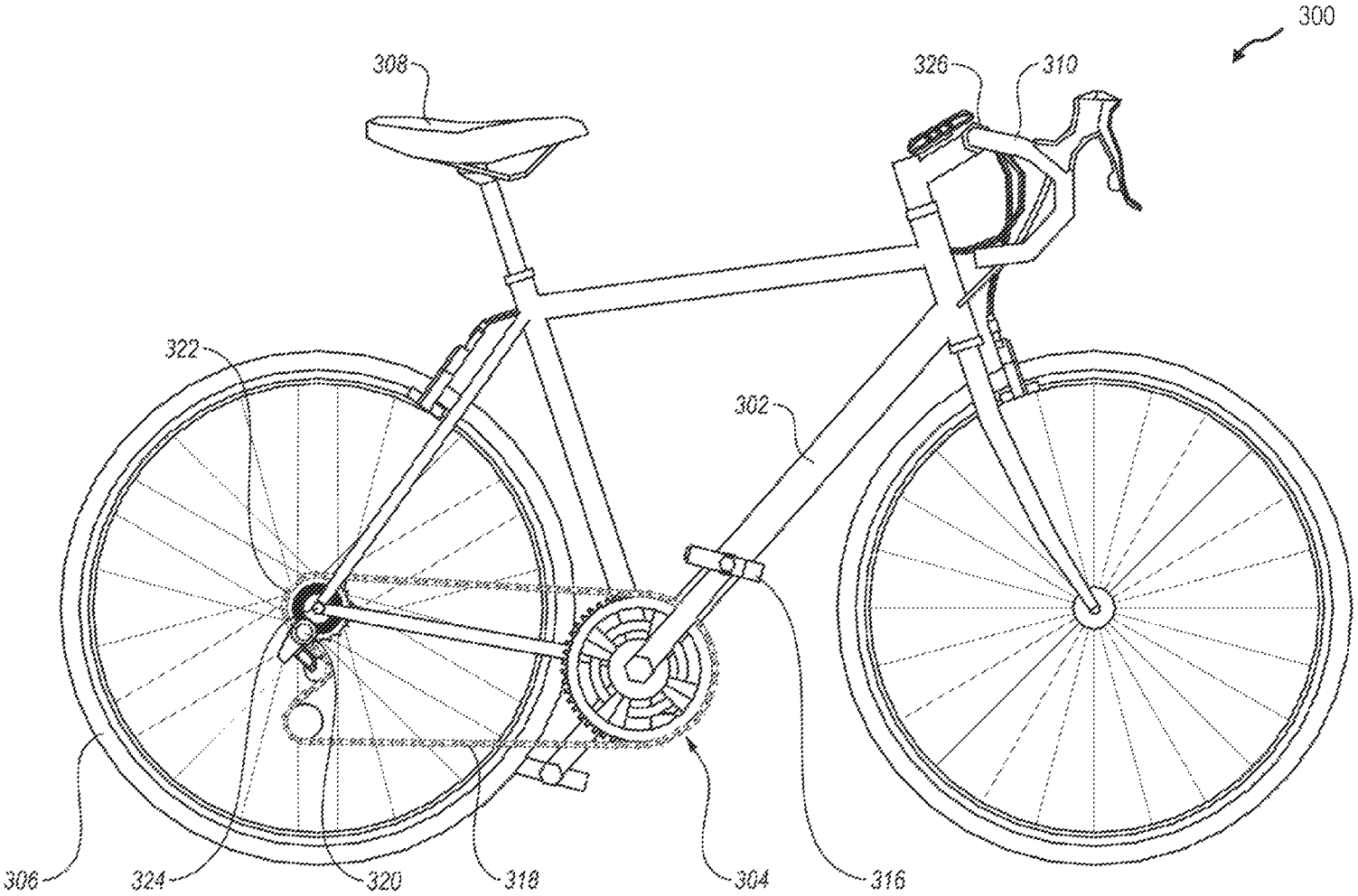
FIG. 3 is a side view of a bicycle, according to at least one embodiment of the present disclosure.

FIG. 1 through FIG. 3 are examples of human-powered cycling systems. Each receives a circular or elliptical input from a user and may transmit that input to a wheel or flywheel in one or two rotational directions. FIG. 1 is a perspective view of an embodiment of an exercise bicycle 100, according to the present disclosure. The exercise bicycle 100 may include a frame 102 that supports a drivetrain 104 and at least one wheel 106. The frame 102 may further support a seat 108 for a user to sit upon, handlebars 110 for a user to grip, one or more displays 112, or combinations thereof. For example, some embodiments of an exercise bicycle 100 may include a seat 108 but lack handlebars 110, as a user may recline in the seat 108 without a need to stabilize herself during riding. Such embodiments may include a display 112 despite lacking handlebars 110.

In some embodiments, an exercise bicycle 100 may use one or more displays 112 to display feedback or other data regarding the operation of the exercise bicycle 100. In some embodiments, the drivetrain 104 may be in data communication with the display 112 such that the display 112 presents real-time information collected from one or more sensors on the drivetrain 104. For example, the display 112 may present information to the user regarding cadence, wattage, simulated distance, duration, simulated speed, resistance, incline, heart rate, respiratory rate, other measured or calculated data, or combinations thereof. In other examples, the display 112 may present use instructions to a user, such as workout instructions for predetermined workout regimens (stored locally or accessed via a network); live workout regimens, such as live workouts broadcast via a network connection; or simulated bicycle rides, such as replicated stages of real-world bicycle races. In yet other examples, the display 112 may present one or more entertainment options to a user during usage of the exercise bicycle 100. The display 112 may display broadcast or cable television, locally stored videos and/or audio, video and/or streamed via a network connection, video and/or audio displayed from a connected device (such as a smartphone, laptop, or other computing device connected to the display 112) or other entertainment sources. In other embodiments, an exercise bicycle 100 may lack a display 112 and provide information regarding the drivetrain 104 or other exercise session data to an external or peripheral device. For example, the exercise bicycle 100 may communicate with a smartphone, wearable device, tablet computer, laptop, or other electronic device to allow a user to log their exercise information.

The exercise bicycle 100 may have a computing device 114 in data communication with one or more components of the exercise bicycle 100. For example, the computing device 114 may allow the exercise bicycle 100 to collect information from the drivetrain 104 and display such information in real-time. In other examples, the computing device 114 may send a command to activate one or more components of the frame 102 and/or drivetrain 104 to alter the behavior of the exercise bicycle 100. For example, the frame 102 may move to simulate an incline or decline displayed on the display 112 during a training session. Similarly, the drivetrain 104 may change to alter resistance, gear, or other characteristics to simulate different experiences for a user. The drivetrain 104 may increase resistance to simulate climbing a hill or other experience that requires greater energy input from the user, or the drivetrain 104 may change gear (e.g., physically or "virtually") and the distance calculated by the computing device 114 may reflect the selected gear.

In some embodiments, the drivetrain 104 may be in data communication with the display 112 such that the drivetrain 104 may change in response to simulate one or more portions of an exercise experience. The display 112 may present an incline to a user and the drivetrain 104 may increase in resistance to reflect the simulated incline. In at least one embodiment, the display 112 may present an incline to the user and the frame 102 may incline and the drivetrain 104 may increase resistance simultaneously to create an immersive experience for a user.

The computing device 114 may allow tracking of exercise information, logging of exercise information, communication of exercise information to an external electronic device, or combinations thereof with or without a display 112. For example, the computing device 114 may include a communications device that allows the computing device 114 to communicate data to a third-party storage device (e.g., internet and/or cloud storage) that may be subsequently accessed by a user.

In some embodiments, the drivetrain 104 may include an input component that receives an input force from the user and a drive mechanism that transmits the force through the drivetrain 104 to a hub that moves a wheel 106. In the embodiment illustrated in FIG. 1, the input component is a set of pedals 116 that allow the user to apply a force to a belt 118. The belt 118 may rotate an axle 120. The rotation of the axle 120 may be transmitted to a wheel 106 by a hub 122. In other embodiments, the belt 118 may rotate a portion of the hub 122, and the wheel 106 and hub 122 may be supported by the axle 120 while remaining rotationally uncoupled from the axle 120. The present disclosure contemplates a drive mechanism engaging with either the axle 120 and/or a portion of the hub 122. In some embodiments, the wheel 106 may be a flywheel.

The hub 122 may be a freewheel hub 122 that allows the wheel 106 to continue rotating if the rotational velocity of the wheel 106 exceeds that of the axle 120. The hub 122 may be a direct drive or "fixed gear" hub 122 that communicates torque between the axle 120 and the wheel 106 in both directions about the rotational axis 124 of the wheel 106, axle 120, and hub 122. In some embodiments, the hub 122 may be selectively movable from a freewheel behavior in an unlocked state to a direct drive behavior in a locked state to further enhance a user's experience and/or provide additional exercise options to a user.

Figures 1, 4:
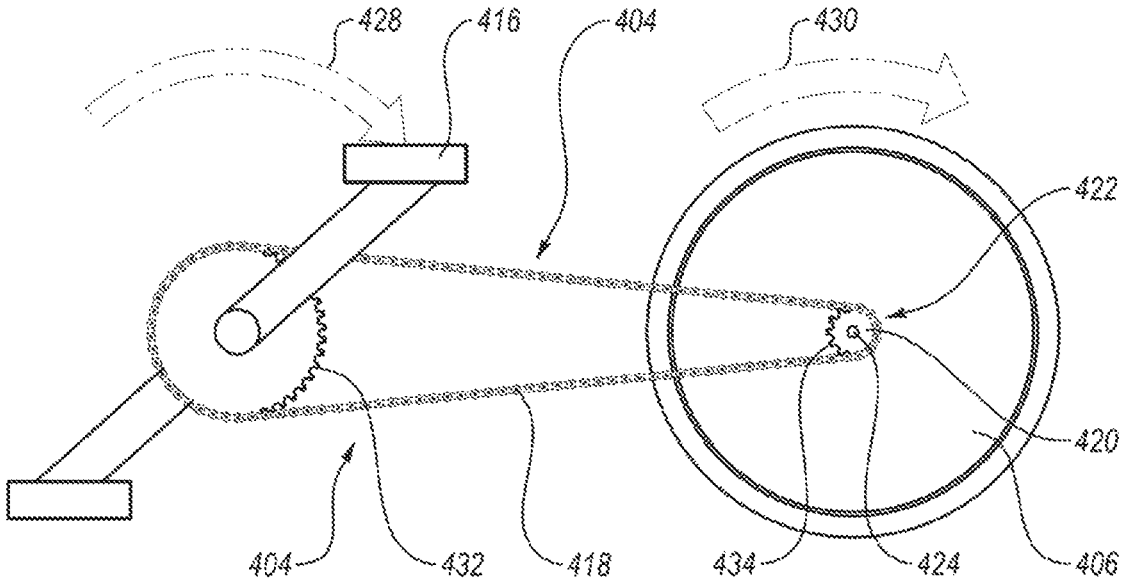
Figures 2, 4:
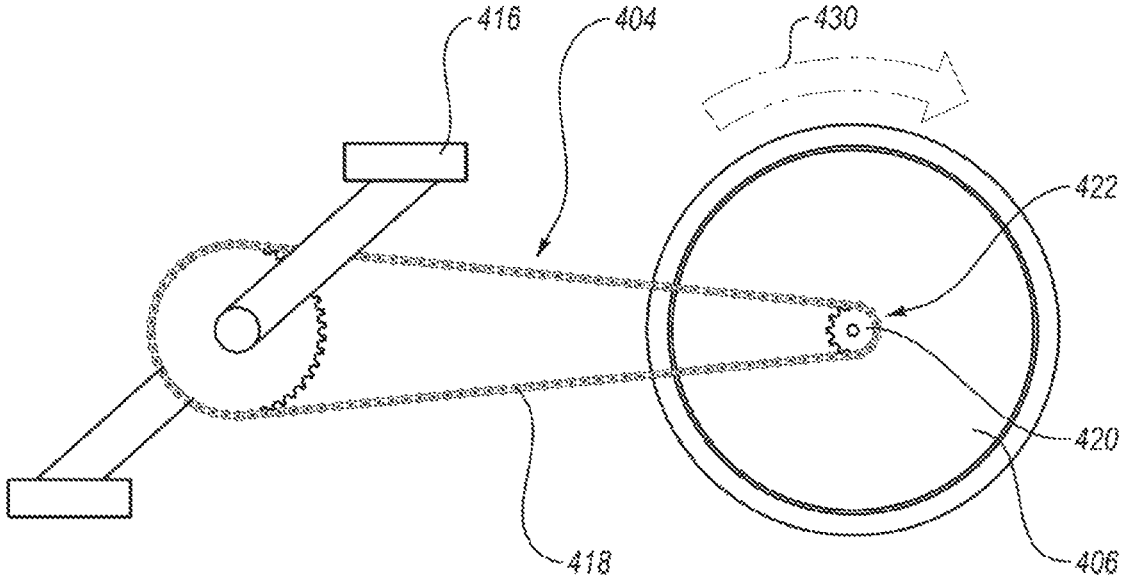
Figures 1, 6:
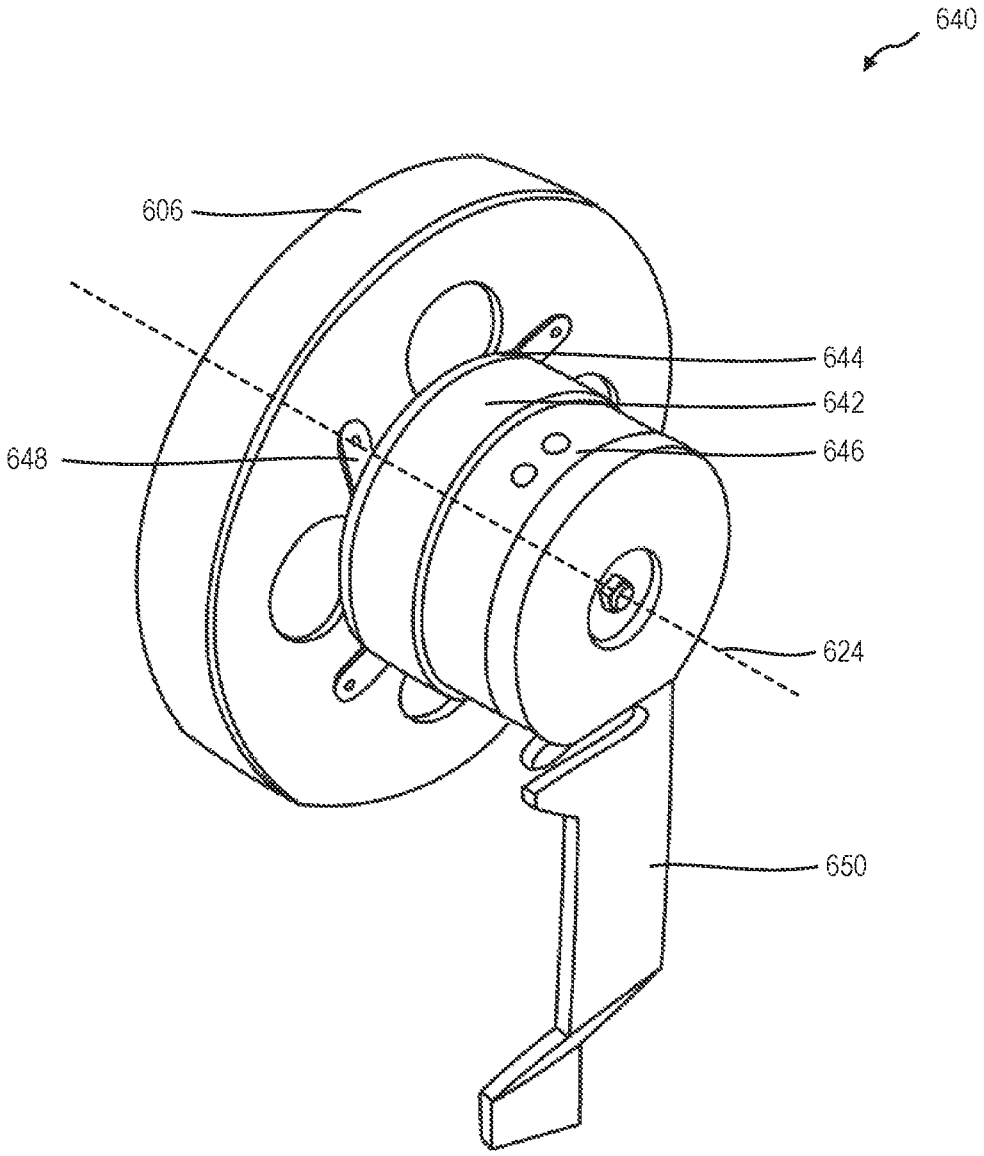
Figures 2, 6:
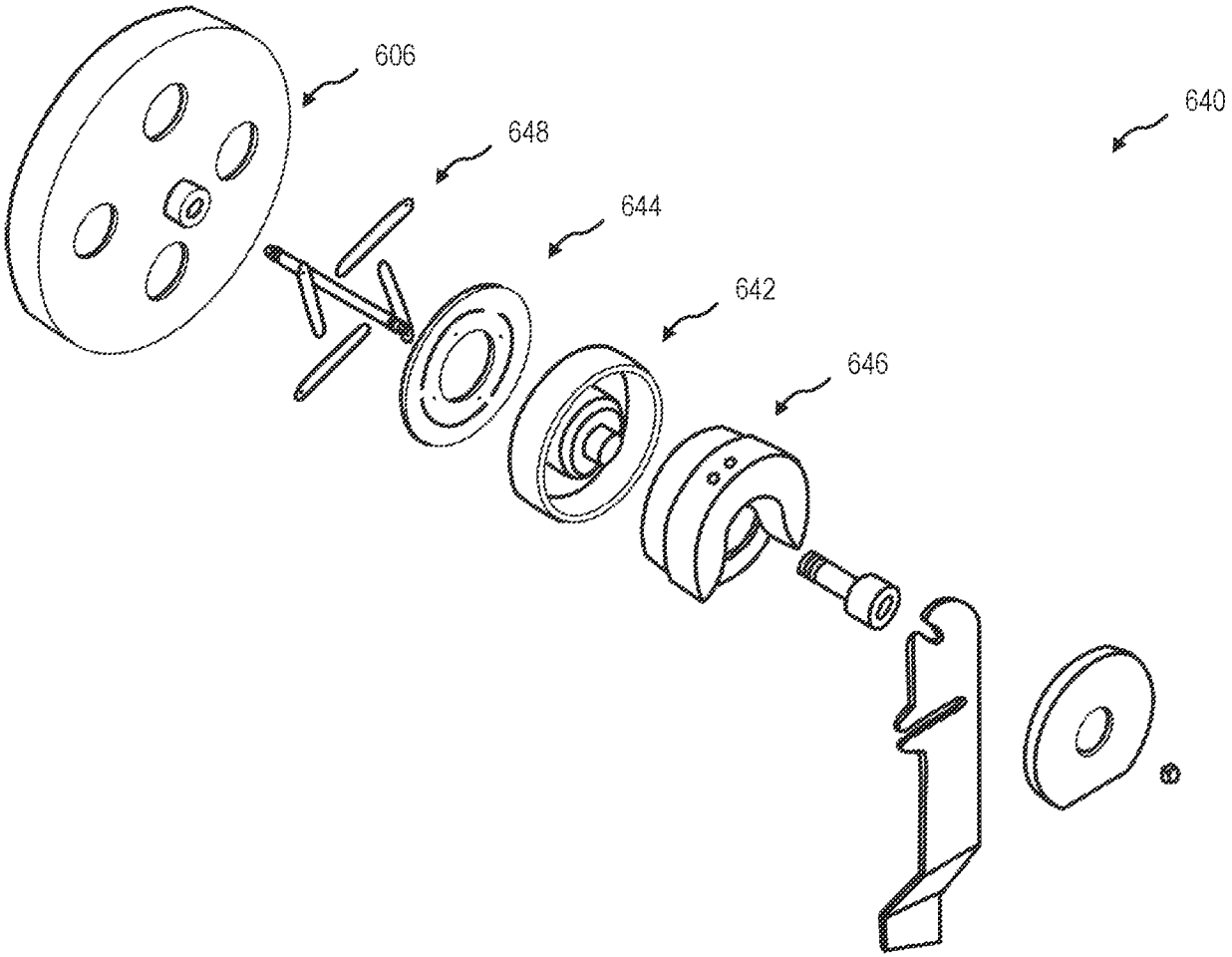
Figures 3, 6:
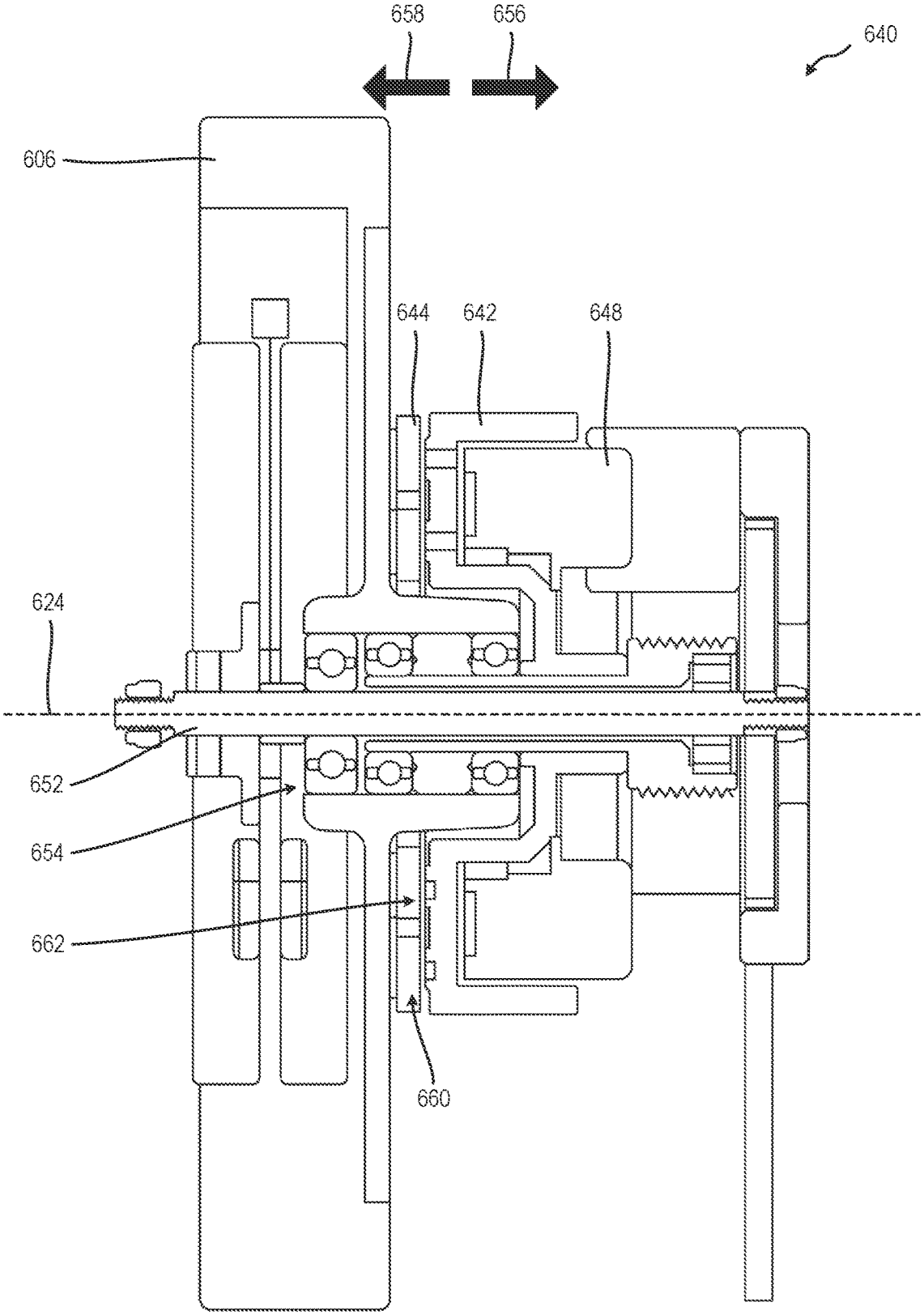
Figures 4, 6:
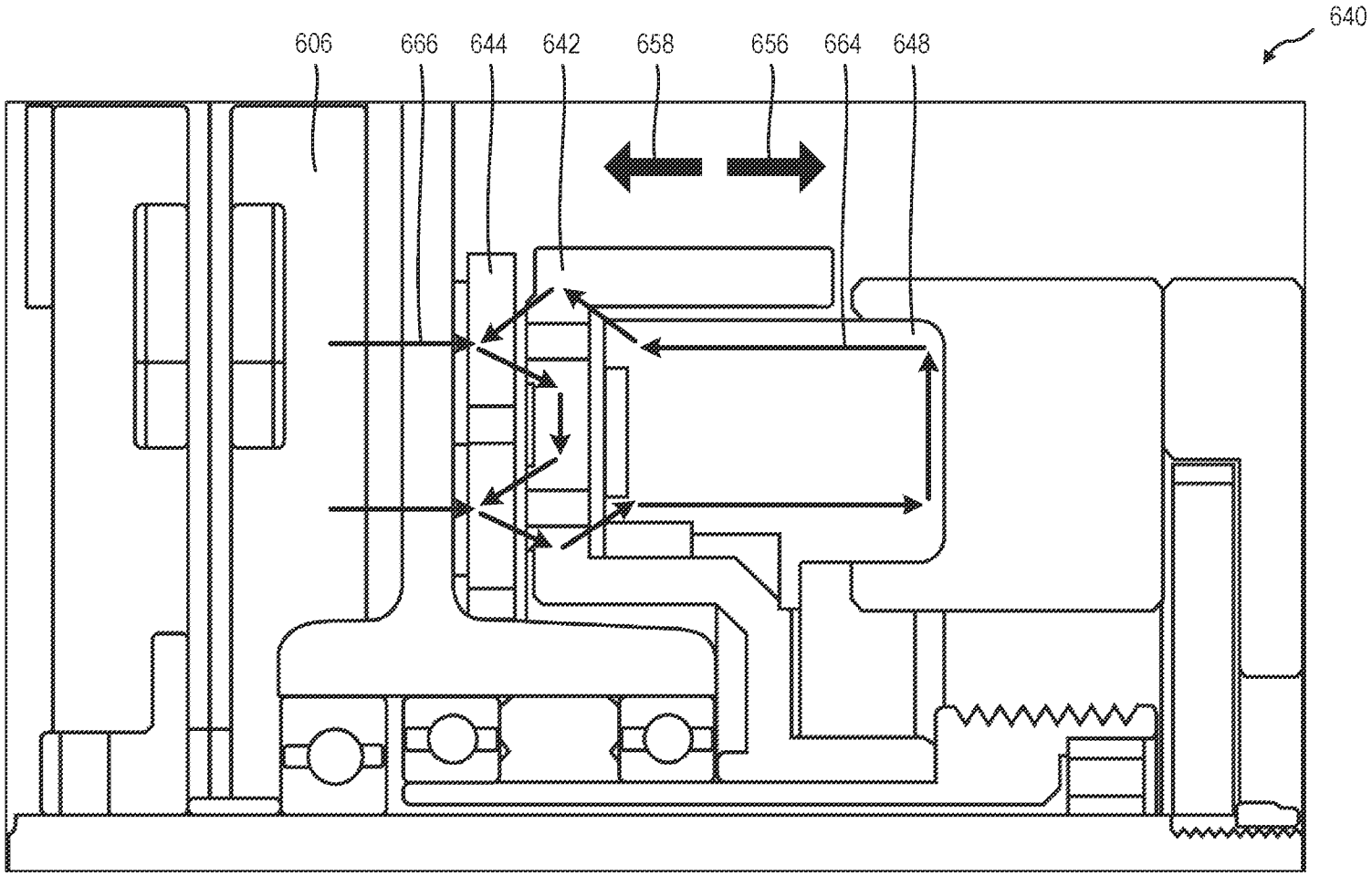

In accordance with embodiments of the present disclosure, the hub 122 may include a magnetic clutch, as described herein with respect to FIG. 6-1 through FIG. 6-4. The magnetic clutch may include a rotor rotationally connected to the drivetrain 104, and specifically to the pedals 116. An armature may be rotationally connected to the wheel 106. When an electric current is passed through the field coil, the generated magnetic field may cause the armature to come into contact with the rotor, thereby rotationally fixing the wheel 106 to the pedals 116 or placing the drivetrain 104 in a fixed gear mode.

The unlocked state may transmit an input torque from the drivetrain to a wheel in a first rotational direction and may transmit little or no torque in a second rotational direction. For example, the unlocked state may transmit substantially all of an input torque (less drivetrain losses and up to a tensile or other yield strength of the components) in the first rotational direction and less than 5% of an input torque in the second rotational direction. In another example, the unlocked state may transmit substantially all of an input torque in the first rotational direction and less than 3% of an input torque in the second rotational direction. In yet another example, the unlocked state may transmit substantially all of an input torque in the first rotational direction and less than 1% of an input torque in the second rotational direction. In at least some examples, the unlocked state may transmit less than 0.1% of an input torque in the second rotational direction.

The locked state may transmit substantially all of an input torque (less drivetrain losses and up to a tensile or other yield strength of the components) in the first rotational direction and in the second rotational direction. In some embodiments, the locked state may transmit greater than 95% of an input torque in the first rotational direction and in the second rotational direction. In other embodiments, the locked state may transmit greater than 97% of an input torque in the first rotational direction and in the second rotational direction. In yet other embodiments, the locked state may transmit greater than 99% of an input torque in the first rotational direction and in the second rotational direction.

In some embodiments, the locked state may transmit greater than 300 Newton-meters (N-m) of torque from the drivetrain to the wheel in the first rotational direction and second rotational direction without slipping of the drivetrain and wheel relative to one another. In other embodiments, the locked state may transmit greater than 400 N-m of torque from the drivetrain to the wheel in the first rotational direction and second rotational direction without slipping of the drivetrain and wheel relative to one another. In some embodiments, the locked state may transmit greater than 500 N-m of torque from the drivetrain to the wheel in the first rotational direction and second rotational direction without slipping of the drivetrain and wheel relative to one another.

In some embodiments in the unlocked state, it is possible for the pedals 116 of the drivetrain 104 to continue moving after input from a user has ceased. For example, the rotational inertia of the wheel 106 may urge the pedals 116 to continue rotating without further input from the user. For safety purposes, a brake 123 may be positioned on or supported by the frame 102 and configured to stop or slow the wheel 106 or other part of the drivetrain 104.

In some embodiments, the brake 123 may be a friction brake, such as a drag brake, a drum brake, caliper brake, a cantilever brake, or a disc brake, that may be actuated mechanically, hydraulically, pneumatically, electronically, by other means, or combinations thereof. In other embodiments, the brake 123 may be a magnetic brake that slows and/or stops the movement of the wheel 106 and/or drivetrain 104 through the application of magnetic fields. In some examples, the brake may be manually forced in contact with the wheel 106 by a user rotating a knob to move the brake 123. In other examples, the brake 123 may be a disc brake with a caliper hydraulically actuated with a lever on the handlebars 110. In yet other examples, the brake may be actuated by the computing device 114 in response to one or more sensors.

In some embodiments, the changing of the drivetrain 104 from a freewheel (unidirectional) drivetrain to a direct-drive (bi-directional) drivetrain may be limited by a lockout device. For example, the drivetrain 104 may be movable between the locked state and the unlocked state below a defined rotational velocity of the wheel 106. In some embodiments, the lockout device may prevent the movement between the locked state and the unlocked state when the wheel 106 has a rotational velocity greater than 60 revolutions per minute (RPM). In other embodiments, the lockout device may prevent the movement between the locked state and the unlocked state when the wheel 106 has a rotational velocity greater than 30 RPM. In yet other embodiment, the lockout device may prevent the movement between the locked state and the unlocked state when the wheel 106 has a rotational velocity greater than 10 RPM. In further embodiments, the lockout device may prevent the movement between the locked state and the unlocked state when the wheel 106 has a rotational velocity greater than 0 RPM. In at least one embodiment, the lockout device may prevent the movement between the locked state and the unlocked state unless the brake 123 is engaged with the wheel 106 and/or drivetrain 104 to prevent movement of the wheel 106 and/or drivetrain.

In other embodiments, the lockout device and/or the safety brake may be in data communication with one or more sensors, such as a speed sensor, a torque sensor, a wattmeter, or other sensor to measure and monitor the user's inputs and movement of the drivetrain 104 and/or wheel 106.

In some embodiments, the exercise bicycle 100 may further include a safety button 125. The safety button 125 may be connected to the drivetrain 104 of the exercise bicycle 100. In some embodiments, the safety button 125 may move the drivetrain 104 from the locked position (e.g., the direct-drive position) to the unlocked position (e.g., the freewheel position). This may help to improve the safety of the exercise bicycle 100 by allowing the user to disengage the locking mechanism from the drivetrain 104. This may allow the pedals 116 to rotate independently of the wheel 106. In this manner, when the user presses the safety button 125, the pedals 116 may stop rotating with the inertia of the wheel 106. This may prevent the pedals 116 from hitting the user or other person, animal, or object in the vicinity of the exercise bicycle 100.

In some embodiments, the safety button 125 may reduce or prevent the use of an emergency brake on the wheel 106. For example, because the safety button 125 may disconnect the rotation of the pedals 116 from the wheel 106, when the user presses the safety button 125, the pedals 116 may be easily stopped without injury. In this manner, the safety of the safety button 125 may be improved without using the emergency brake.

As discussed herein, the clutch may be a magnetic clutch. In some embodiments, the safety button 125 may cause the magnetic clutch to move from the locked position to the unlocked position. This may disengage the wheel 106 from the pedals 116. In some embodiments, as discussed herein, the magnetic clutch may be prevented from re-engaging until the wheel 106 has come to a complete stop. For example, the magnetic clutch may be prevented from re-engaging until the wheel 106 has come to a complete stop through instructions programmed into the computing device 114 and/or through a mechanical stop.

FIG. 2 is another embodiment of a cycling system that may be used for exercise. An elliptical trainer 200 may include a frame 202 that supports a drivetrain 204 connected to a wheel 206 with a safety brake 223. The frame 202 may support a display 212 and/or computing device 214 to present, track, log, store, or communicate information for a user. In some embodiments, the drivetrain 204 may have inputs from the user including both handlebars 210 and pedals 216. For example, the drive mechanism, such as the linkage 218 of the illustrated embodiment, may receive force from the user through movement of the handlebars 210 and/or the pedals 216. The pedals 216 may cycle through an elliptical path, while the handlebars 210 may oscillate in an arcuate path (arrows A and B), to drive the linkage 218. In other embodiments, the drivetrain 204 may have stationary handlebars 210 and the pedals 216 may drive the linkage 218 independently of the handlebars 210. The linkage 218 may rotate an axle 220, and the rotation of the axle 220 may be transmitted to the wheel 206 by a hub 222.

The hub 222 may be a freewheel hub 222 that allows the wheel 206 to continue rotating if the rotational velocity of the wheel 206 exceeds that of the axle 220. The hub 222 may be a direct drive hub 222 that communicates torque between the axle 220 and the wheel 206 in both directions about the rotational axis 224 of the wheel 206, axle 220, and hub 222. In some embodiments, the hub 222 may be selectively movable from a freewheel behavior to a direct drive behavior to further enhance a user's experience and/or provide additional exercise options to a user. In accordance with embodiments of the present disclosure, the hub 222 may transition between the freewheel mode and the fixed gear mode using a magnetic clutch.

FIG. 3 is a side view of an embodiment of another cycling system, according to the present disclosure. In some embodiments, a bicycle 300 may have a frame 302 that supports a drivetrain 304 configured to rotate a wheel 306 and seat 308 and/or handlebars 310 to support a user. The drivetrain 304 may include pedals 316 to receive input force from a user and drive mechanism, such as a chain 318 or belt, to transmit the force to an axle 320. A hub 322 may transmit torque from the axle 320 to the wheel 306 to rotate the wheel 306 about a rotational axis 324.

The hub 322 may be a freewheel hub 322 that allows the wheel 306 to continue rotating if the rotational velocity of the wheel 306 exceeds that of the axle 320. The hub 322 may be a direct drive hub 322 that communicates torque between the axle 320 and the wheel 306 in both directions about the rotational axis 324 of the wheel 306, axle 320, and hub 322. In some embodiments, the hub 322 may be selectively movable from a freewheel behavior to a direct drive behavior to further enhance a user's experience and/or provide additional exercise options to a user. In some embodiments, the hub 322 may be movable between a locked position and an unlocked position by a controller 326 positioned on the handlebars 310 or other location accessible by the user during use of the bicycle 300. For example, the controller 326 may be electrically connected to a magnetic clutch located at the hub 322. The user may toggle the controller 326 to activate the magnetic clutch. When the magnetic clutch is activated, an armature may be drawn toward a rotor connected to the pedals 316, and thereby the wheel 306 rotationally with respect to the pedals 316. When the user toggles the controller 326 to deactivate the magnetic clutch, the hub 322 may move back into a freewheel mode.

Figure 5:
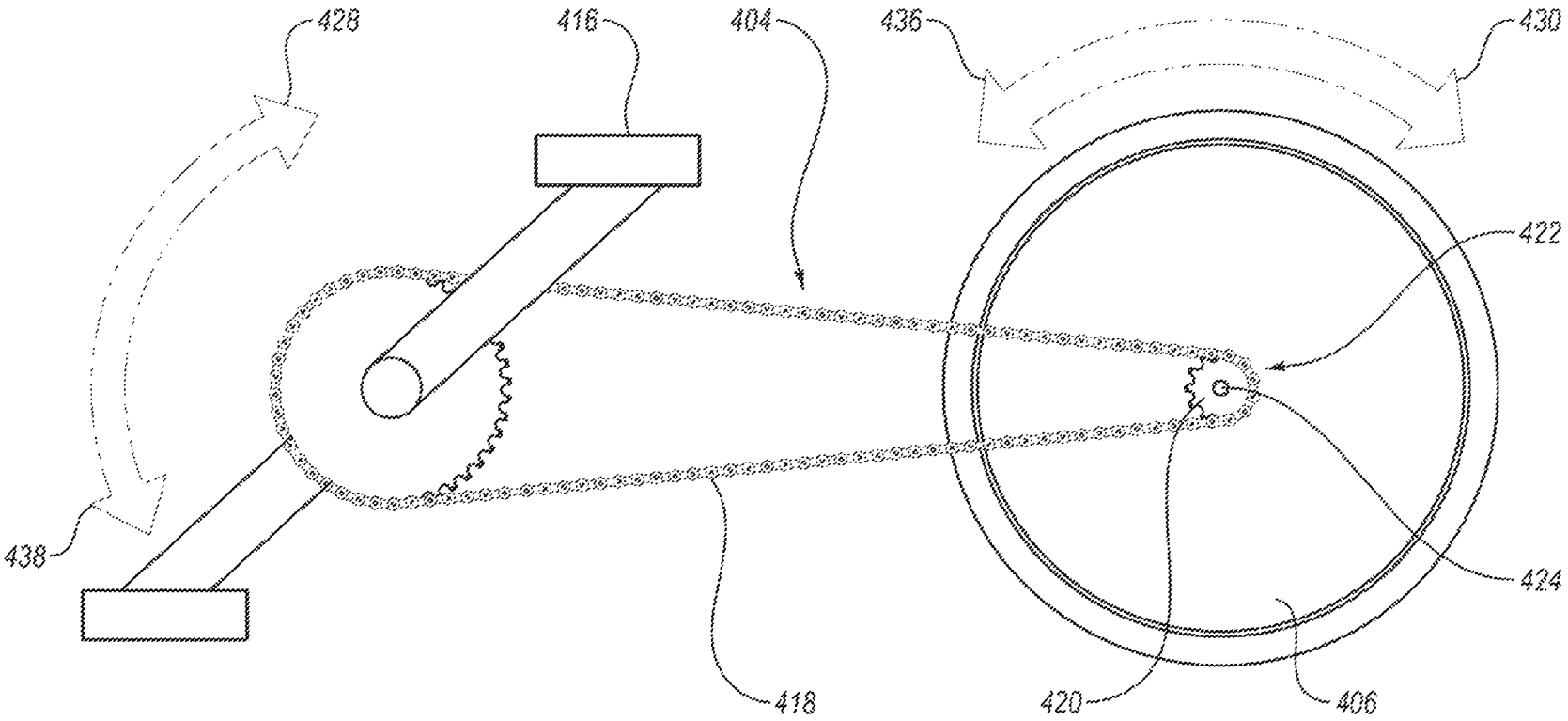
FIG. 5 is a side schematic representation of the embodiment of a drivetrain and wheel of FIGS. 4-1 and 4-2 in a locked state.

FIG. 4-1 through FIG. 5 are schematic representations of an embodiment of a drivetrain and wheel that may be used in the cycling systems described herein (e.g., the exercise bicycle 100 described in relation to FIG. 1, elliptical trainer 200 described in relation to FIG. 2, and bicycle 300 described in relation to FIG. 3). A pedaled drivetrain 404 may be configured to rotate a wheel 406. A "pedaled drivetrain", as used herein, may include any linkage, mechanism, or system that receives an input force from a human in a cyclic pattern and transmits that force to rotate a wheel. For example, a pedaled drivetrain may include platform pedals, as are common on exercise bicycles and conventional bicycles for transportation. In other examples, a pedaled drivetrain may include "clipless pedals" that engage with a cleat on a user's shoe to allow more efficient power transfer to the drivetrain throughout the pedal stroke. In yet other examples, a pedaled drivetrain may include hand pedals or grips that allow a user to cycle the pedals of the drivetrain with their hands, for example, to strengthen or rehabilitate the user's upper body. In further examples, a drivetrain having hand pedals may allow a user with limited or no lower body control to operate a cycling system for exercise and/or transportation.

FIG. 4-1 is a side view of a drivetrain 404 in an unlocked state transmitting a forward torque 428 from pedals 416 to a wheel 406 about a rotational axis 424 of the wheel 406 in a first rotational direction 430. The drivetrain 404 may include a drive mechanism that transmits the force from the pedals 416 to the wheel 406. The chain 418 may engage with a first gear 432 rotatable by the pedals 416. The chain 418 may also engage with a second gear 434 on the axle 420 to apply a torque to the axle 420 around the rotational axis 424 and rotate the axle 420. The axle 420 transmits torque to the wheel through a hub 422. In FIG. 4-1, the hub 422 is a freewheel hub that transmits torque in the first rotational direction 430. In accordance with embodiments of the present disclosure, in the freewheel mode shown in FIG. 4-1 and FIG. 4-2, a magnetic clutch is disengaged. Without a magnetic force pulling an armature to a rotor rotationally fixed to the pedals 416, biasing elements may pull the armature back toward the wheel 406, thereby placing the hub 422 in freewheel mode.

FIG. 4-2 illustrates the drivetrain 404 of FIG. 4-1 with the pedals 416 moving at a slower rotational rate than the wheel 406 in the first rotational direction 430. For example, the pedals 416 may be stationary as the wheel 406 rotates due to rotational inertia or due to contact with the ground while a bicycle is moving. In other examples, the pedals 416 may be rotating in a second rotational direction, opposite the first rotational direction. The pedals 416 may move the chain 418 and axle 420 in the second rotational direction, and the freewheel hub 422 may transmit little or no torque to the wheel 406 to disrupt the rotation of the wheel 406 in the first rotational direction 430.

FIG. 5 is a side view of the drivetrain 404 of FIG. 4-1 in a second, locked state. To transition from the freewheel or unlocked state of FIG. 4-1 and FIG. 4-2 to the locked state shown in FIG. 5, the magnetic clutch has been engaged. Electricity running through the field coil may draw the armature to the rotor, thereby rotationally locking the armature and the wheel 406 to the rotor. This may cause the wheel 406 to be rotationally locked or fixed relative to the pedals 416, thereby placing the wheel 406 in the locked state. In the locked state, the drivetrain 404 may transmit torque to the wheel 406 in both the first rotational direction 430 and in an opposing second rotational direction 436 about the rotational axis 424. For example, in the locked state, the torque from rotation of the axle 420 is directly transmitted to the wheel 406 in either rotational direction.

For example, a user may apply a forward torque 428 to the pedals 416, which is transmitted through the chain 418 to the axle 420. The drivetrain 404 rotationally locks the axle 420 and wheel 406 in the locked state. Movement of the wheel 406, conversely, may apply a torque to the axle 420 through the hub 422, moving the pedals 416. For example, when the wheel is moving in the first rotational direction 430, the pedals 416 also move. The user may apply a rearward torque 438 through the pedals 416 to decelerate the wheel 406 (i.e., accelerate the wheel 406 in the second rotational direction 436) without the need for other brakes on the wheel 406 itself.

In some embodiments, the drivetrain may transition between the unlocked state and the locked state during movement of the drivetrain, and in other embodiments, the drivetrain may transition from the unlocked state to the locked state when the drivetrain is stationary. In yet other embodiments, a drivetrain may be configured to transition from the unlocked state to the locked state both during movement and while stationary. In at least one example, a drivetrain may transition between the unlocked state and the locked state while the axle of the drivetrain and the wheel are moving at an equivalent rotational velocity.

FIG. 6-1 is a representation of a magnetic clutch 640, according to at least one embodiment of the present disclosure. The magnetic clutch 640 may be used to transition a drivetrain of an exercise device (e.g., the drivetrain 404 of FIG. 4-1 through FIG. 5) between the locked and the unlocked state. In some embodiments, the magnetic clutch 640 may lock the rotation of a flywheel 606 to the rotation of a rotor 642. The rotor 642 may be rotationally fixed to a pedal of an exercise device (e.g., the pedal 416 of FIG. 4-1 through FIG. 5).

To lock the rotation of the flywheel 606 to the rotor 642, an armature 644 may be rotationally fixed to the flywheel 606. A field coil 646 may generate a magnetic field that causes the armature 644 to move axially along a rotational axis 624 of the flywheel 606. The magnetic field may cause the armature 644 to come into contact with the rotor 642. Friction between the armature 644 and the rotor 642 may cause the armature 644, and therefore the rotor 642, to become rotationally fixed to the rotor 642. In this manner, when the magnetic clutch 640 is activated, the flywheel 606 may be placed in the locked position.

In some embodiments, the magnetic clutch 640 may include one or more resilient elements 648. The resilient elements 648 may bias the armature 644 toward the unlocked position. Put another way, the resilient elements 648 may bias the armature 644 toward the flywheel 606. When the magnetic clutch 640 is not activated, the resilient elements 648 may pull the armature 644 toward the flywheel 606, causing the armature 644 to be disconnected from the rotor 642. When the magnetic clutch 640 is activated, the magnetic force pulling the armature 644 toward the rotor 642 may be greater than the biasing force from the resilient elements 648 pulling the armature 644 toward the flywheel 606.

In some embodiments, the magnetic clutch 640 may be connected to a frame of an exercise device with a mounting element 650. The mounting element 650 may connect the magnetic clutch 640 to the frame of the exercise device.

In some embodiments, the magnetic clutch 640 may be activated by a controller (e.g., the controller 326 of FIG. 3) on the exercise device. In some embodiments, the controller may be a manual controller. For example, the controller may be a switch, a toggle, a button, or any other manual controller. In some embodiments, the controller may be an electric controller, such as an input on an operating system, an input on a console, or other electric input. In some embodiments, the controller may receive voice input from the user. For example, the controller may include a microphone and voice-recognition software. The controller may recognize one or more words, phrases, or sentences that indicate that the user desires to activate the magnetic clutch 640. When the user desires to change between locked and unlocked modes, the user may simply state "lock flywheel," "unlock flywheel," or other command words/phrases. The microphone may pick up the user's words, and the voice-recognition software may recognize the words as an instruction to activate or deactivate the magnetic clutch 640. Based on the identified instruction, the controller may then activate or deactivate the magnetic clutch 640. In some embodiments, the voice-recognition software may recognize predetermined phrases. In some embodiments, the voice-recognition software may recognize plain text speech and identify the instructions from the plain text speech.

In some embodiments, the controller may be physically wired to the magnetic clutch 640. In some embodiments, the controller may be wirelessly connected to the magnetic clutch 640. For example, the controller may be connected to the magnetic clutch using any type of wireless connection, such as Bluetooth, Wi-Fi, Zigbee, IR transmission, NFC, cellular network (e.g., 3G, 4G, 5G, or any other cellular network), any other wireless connection, and combinations thereof.

In some embodiments, the magnetic clutch 640 may be activated by a remote signal. For example, the magnetic clutch 640 may be connected to a remote computing device. The remote computing device may provide an activation instruction to the magnetic clutch 640. In some embodiments, the remote computing device may be wirelessly connected to the magnetic clutch 640 using a wireless connection, as discussed herein. In some embodiments, the remote computing device may be connected to the magnetic clutch 640 over the Internet.

In some embodiments, the activation or deactivation signal to the magnetic clutch 640 may be a part of an exercise program. An exercise program may have many different exercise activities or motions for a user to perform.

In some embodiments, an exercise program may include exercise activities that include the use of the flywheel 606 in the locked or unlocked configuration. When an exercise program reaches an exercise activity that involves a change in the configuration of the flywheel 606, the exercise program may send an instruction to the magnetic clutch 640 to change between the locked and the unlocked configuration.

In some embodiments, operating an exercise device in the locked configuration may cause the pedals to rotate for as long as the flywheel is rotating. In some situations, this may cause the pedals to strike the user, potentially causing an injury to the user. In some embodiments, the exercise device may detect when the user is performing an exercise activity. For example, the exercise device may include a sensor that may detect when the user is using the exercise device, such as a force sensor on the pedals, a weight sensor on the seat, an optical sensor, any other type of sensors, and combinations thereof.

In some embodiments, the exercise device may detect when the user is using the exercise device. The exercise device may activate or deactivate the magnetic clutch 640 based on the status of the user using the exercise device. For example, while the user is using the exercise device (e.g., when the pedal sensor senses that the user is applying a force to the pedal), the magnetic clutch 640 may be activated, placing the flywheel 606 in the locked configuration. In some examples, when the user stops using the exercise device (e.g., when the pedal sensor senses that the user has stopped applying a force to the pedal), the magnetic clutch 640 may be deactivated, placing the flywheel 606 in the unlocked configuration (e.g., the freewheel mode). This may help to improve the safety of the exercise device by preventing or reducing the chance of the pedal striking the user when the user is no longer performing an exercise activity.

As discussed herein, embodiments of the present disclosure have been described with the field coil 646 being located on the same side of the flywheel 606 as the rotor 642, such that when the field coil 646 produces a magnetic field, the armature 644 is drawn toward the rotor. However, it should be understood that the field coil 646 may be located inside the flywheel 606, or on an opposite side of the flywheel from the rotor 642. The biasing elements 648 may bias the armature toward the rotor 642 such that the armature 644 is normally in contact with the rotor 642 thereby placing the flywheel 606 in the locked position. When the field coil 646 generates a magnetic field, the armature 644 may be moved away from the rotor 642 and become disengaged from the rotor 642, thereby placing the flywheel 606 in the unlocked position.

FIG. 6-2 is an exploded view of the magnetic clutch of FIG. 6-1. As may be seen, the biasing element 648 may be located between the flywheel and the armature 644. The biasing element 648 may bias the armature 644 toward the flywheel 606. As discussed herein, the armature 644 may be rotationally fixed to the flywheel 606. In some embodiments, a rotor 642 may be located next to the armature 644. A field coil 646 may be inserted into a cavity in the rotor 642. When the field coil 646 is activated, the armature 644 may be pulled toward the field coil 646, which may place the armature 644 in contact with the rotor 642.

FIG. 6-3 is a cross-sectional view of the magnetic clutch 640 of FIG. 6-1. As may be seen, a central axle 652 extends through the entirety of the magnetic clutch 640 along the rotational axis 624. The central axle extends through the flywheel 606, the armature 644, the rotor 642, and the field coil 646. The central axle 652 may be rotationally connected to the drive mechanism. For example, the central axle 652 may be rotationally connected to the pedals such that when the pedals are rotated, the central axle 652 is rotated.

In some embodiments, the flywheel 606 may be connected to the central axle 652 with a freewheel hub 654. The freewheel hub 654 may transfer torque from the central axle 652 to the flywheel 606 in a first direction, while allowing the central axle 652 to freely rotate without transferring torque in a second direction. In some embodiments, the rotor 642 may be rotationally fixed to the central axle 652 such that the central axle 652 may transfer torque to the rotor 642 in both the first direction and the second direction.

As discussed herein, the armature 644 may be rotationally fixed to the flywheel 606. The magnetic field generated by the field coil 646 may draw the armature 644 in a first direction 656 toward the field coil 646 and/or the rotor 642. When the field coil 646 is deactivated, then one or more biasing elements may bias or pull the armature 644 in a second direction 658 back toward the flywheel 606.

In some embodiments, the magnetic field may cause the armature 644 to come into contact with the rotor 642. The armature 644 may engage the rotor 642 with a friction force. The friction force may be a function of the contact area of the contact between the armature 644 and the rotor 642, the coefficient of friction, and the contact force of the armature 644 against the rotor 642 caused by the magnetic field. In some embodiments, the friction force may allow the rotor 642 to apply a torque to the flywheel 606.

In some embodiments, the friction force may allow the user to apply a torque that is opposite the direction of rotation of the flywheel 606. For example, the user may desire to exercise different muscles by slowing down rotation of the flywheel using the pedals. With the magnetic clutch 640 engaged, the friction force between the rotor 642 and the flywheel 606 may transfer the opposite torque to the flywheel 606. In some embodiments, the frictional connection between the armature 644 and the rotor 642 may transfer 300 N-m of torque without slipping (e.g., without any relative rotation between the armature 644 (and the connected flywheel 606) and the rotor 642). In some embodiments, the frictional connection may transfer 400 N-m of torque without slipping. In some embodiments, the frictional connection may transfer 500 N-m of torque without slipping. In some embodiments, the frictional connection may transfer greater than 500 N-m of torque without slipping.

In some embodiments, the frictional force may be based on the materials of one or both of the armature 644 and the rotor 642, particularly the interaction of the material of an armature contact surface 660 and the material of a rotor contact surface 662. For example, the armature 644 and the rotor 642 may be formed from a metal, such as a steel alloy, an aluminum alloy, or any other metal. In some embodiments, the armature contact surface 660 and/or the rotor contact surface 662 may include a coating of a high-friction material. For example, the armature contact surface 660 and/or the rotor contact surface 662 may include a rubber coating. In some examples, the armature contact surface 660 and/or the rotor contact surface 662 may include a ceramic material, a semi-metallic material, a composite material, any other material, and combinations thereof. In some embodiments, the armature 644 and/or the rotor 642 may include an attached friction plate. The friction plate may be connected to the armature 644 and/or the rotor 642 and may be formed from a high friction material to increase the coefficient of friction between the armature 644 and the rotor 642.

In some embodiments, the armature contact surface 660 and/or the rotor contact surface 662 may have a surface roughness that is configured to increase the frictional force between the armature 644 and the rotor 642. For example, the armature contact surface 660 and/or the rotor contact surface 662 may include one or more bumps, protrusions, or other surface roughness features that interact with corresponding surface roughness features on the opposing surface that increase the frictional force between the armature 644 and the rotor 642. In some embodiments, the armature contact surface 660 and/or the rotor contact surface 662 may include one or more interlocking elements, such as matching protrusions and indentations in opposing surface. The protrusions and indentations may have sloped surfaces to assist in placing the armature 644 and the rotor 642 in the locked position during activation of the magnetic clutch 640.

In some embodiments, the magnetic clutch 640 may be engaged while the flywheel 606 is stationary (e.g., when the flywheel is not rotating). In some embodiments, the magnetic clutch 640 may be engaged while the flywheel 606 is rotating. In some embodiments, the magnetic clutch 640 may be engaged while both the flywheel 606 and the rotor 642 are rotating. In some embodiments, the magnetic clutch 640 may be engaged when the flywheel 606 is rotating and the rotor 642 is stationary (e.g., when the rotor 642 is not rotating).

In some embodiments, the magnetic clutch 640 may only be engaged when the rotor 642 is rotating at the same rotational rate as the flywheel 606. This may help prevent a sudden increase in rotational rate of the pedals, which may injure the user. In some embodiments, the magnetic clutch 640 may include one or more sensors that may determine when the flywheel 606 is rotating at the same rate as the flywheel 606. For example, the flywheel 606 and the rotor 642 may include an accelerometer that may determine their rotational rate. In some embodiments, the pedals may include a sensor to determine if the user is applying a force to rotate the pedals. If the user is applying a force to rotate the pedal, then the user is rotating the flywheel 606. When the user is rotating the flywheel 606, the central axle 652 may be applying a torque to the flywheel 606. Because the rotor 642 is rotationally connected to the central axle 652, then the rotor 642 may be rotated at the same rate as the flywheel 606. In some embodiments, the freewheel hub 654 may include a sensor to determine when the central axle 652 is applying a torque to the flywheel 606. When the sensor determines that the central axle 652 is applying a torque to the flywheel 606 (such as when one of the ratcheting members of the freewheel hub 654 has a force applied to it), then the rotor 642 may be rotating at the same rate as the flywheel.

In some embodiments, the magnetic clutch 640 may be disengaged at any time. for example, the magnetic clutch 640 may be disengaged while the flywheel 606 is rotating and/or while the rotor 642 is rotating. This may help to improve the safety of the exercise device if the user stops using the exercise device while the flywheel 606 is rotating by disengaging the rotor 642 from the flywheel 606, thereby stopping the pedals from rotating with the flywheel 606.

FIG. 6-4 is a close-up cross-sectional view showing an upper half of the magnetic clutch 640 of FIG. 6-1. When an electric current is applied to the field coil 646, the field coil may generate a magnetic field 664. In some embodiments, the rotor 642 may be formed from a magnetically permeable material. The magnetic field 664 may pass through the rotor 642 and into the armature 644. As may be seen, the magnetic field 664 may pass between the armature 644 and the rotor 642 multiple times. The magnetic field may magnetize the armature 644, thereby applying a magnetic force 666 to the armature 644. The magnetic force 666 may urge the armature 644 in the first direction 656. This may cause the armature 644 to come into contact with the rotor 642. As may be understood, the field coil 646 and the armature 644 may be cylindrical, and the magnetic force 666 may be applied to the armature 644 around its circumference. In some embodiments, the strength of the magnetic field 664 and the magnitude of the magnetic force 666 may be varied by changing a size of the field coil and/or the amount of electric current passed through the field coil 646.

Figure 7:
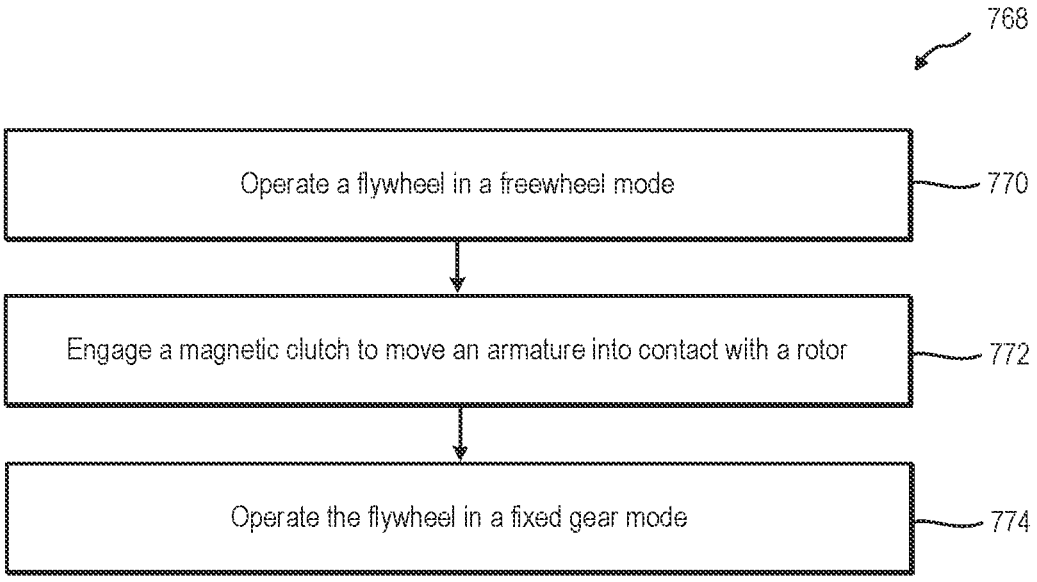
FIG. 7 is a representation of a method for transmitting torque in a pedaled drivetrain.

FIG. 7 is a representation of a method 768 of transmitting torque in a pedaled drivetrain, according to at least one embodiment of the present disclosure. The method 768 may include operating a flywheel in a freewheel mode at 770. In the freewheel mode, a first torque applied by a pedal in a first direction is transferred to the flywheel and a second torque applied by the pedal in in a second direction is not transferred to the flywheel. A magnetic switch may be engaged to move an armature into contact with a rotor at 772. The armature may be rotationally fixed to the flywheel and the rotor may be rotationally fixed to the pedal. The method 768 may include operating the flywheel in a fixed gear mode at 776. In the fixed gear mode, the first torque and the second torque are transferred to the flywheel.

In some embodiments, the method may include activating the magnetic clutch with a controller on a handlebar of the exercise device. As discussed herein, activating the magnetic clutch may be based on an input from an exercise program. In some embodiments, activating the magnetic clutch may be based on an input from a sensor on the exercise device. In some embodiments, activating the magnetic clutch may be based on an input from a user.

INDUSTRIAL APPLICABILITY

This disclosure generally relates to devices, systems, and methods for transferring a flywheel on an exercise device between a fixed gear and a freewheel mode. The exercise device may include a magnetic clutch as part of the drivetrain. The magnetic clutch may be activated or engaged to rotationally fix the flywheel to the pedals in the drivetrain. The magnetic clutch includes an armature and a field coil. When electrified, the field coil generates a magnetic field that attracts the armature to a rotor. When the armature is in contact with the rotor, the flywheel is rotationally fixed to the pedal. This may help to allow the user to easily and effectively change between the freewheel mode and the fixed gear mode.

In some embodiments, an exercise bicycle may include a frame that supports a drivetrain and at least one wheel. The frame may further support a seat for a user to sit upon, handlebars for a user to grip, one or more displays, or combinations thereof. For example, some embodiments of an exercise bicycle may include a seat but lack handlebars, as a user may recline in the seat without a need to stabilize herself during riding. Such embodiments may include a display despite lacking handlebars.

In some embodiments, an exercise bicycle may use one or more displays to display feedback or other data regarding the operation of the exercise bicycle. In some embodiments, the drivetrain may be in data communication with the display such that the display presents real-time information collected from one or more sensors on the drivetrain. For example, the display may present information to the user regarding cadence, wattage, simulated distance, duration, simulated speed, resistance, incline, heart rate, respiratory rate, other measured or calculated data, or combinations thereof. In other examples, the display may present use instructions to a user, such as workout instructions for predetermined workout regimens (stored locally or accessed via a network); live workout regimens, such as live workouts broadcast via a network connection; or simulated bicycle rides, such as replicated stages of real-world bicycle races. In yet other examples, the display may present one or more entertainment options to a user during usage of the exercise bicycle. The display may display broadcast or cable television, locally stored videos and/or audio, video and/or streamed via a network connection, video and/or audio displayed from a connected device (such as a smartphone, laptop, or other computing device connected to the display) or other entertainment sources. In other embodiments, an exercise bicycle may lack a display and provide information regarding the drivetrain or other exercise session data to an external or peripheral device. For example, the exercise bicycle may communicate with a smartphone, wearable device, tablet computer, laptop, or other electronic device to allow a user to log their exercise information.

The exercise bicycle may have a computing device in data communication with one or more components of the exercise bicycle. For example, the computing device may allow the exercise bicycle to collect information from the drivetrain and display such information in real-time. In other examples, the computing device may send a command to activate one or more components of the frame and/or drivetrain to alter the behavior of the exercise bicycle. For example, the frame may move to simulate an incline or decline displayed on the display during a training session. Similarly, the drivetrain may change to alter resistance, gear, or other characteristics to simulate different experiences for a user. The drivetrain may increase resistance to simulate climbing a hill or other experience that requires greater energy input from the user, or the drivetrain may change gear (e.g., physically or "virtually") and the distance calculated by the computing device 114 may reflect the selected gear.

In some embodiments, the drivetrain may be in data communication with the display such that the drivetrain may change in response to simulate one or more portions of an exercise experience. The display may present an incline to a user and the drivetrain may increase in resistance to reflect the simulated incline. In at least one embodiment, the display may present an incline to the user and the frame may incline and the drivetrain may increase resistance simultaneously to create an immersive experience for a user.

The computing device may allow tracking of exercise information, logging of exercise information, communication of exercise information to an external electronic device, or combinations thereof with or without a display. For example, the computing device may include a communications device that allows the computing device to communicate data to a third-party storage device (e.g., internet and/or cloud storage) that may be subsequently accessed by a user.

In some embodiments, the drivetrain may include an input component that receives an input force from the user and a drive mechanism that transmits the force through the drivetrain to a hub that moves a wheel. In some embodiments, the input component is a set of pedals that allow the user to apply a force to a belt. The belt may rotate an axle. The rotation of the axle may be transmitted to a wheel by a hub. In other embodiments, the belt may rotate a portion of the hub, and the wheel and hub may be supported by the axle while remaining rotationally uncoupled from the axle. The present disclosure contemplates a drive mechanism engaging with either the axle and/or a portion of the hub. In some embodiments, the wheel may be a flywheel.

The hub may be a freewheel hub that allows the wheel to continue rotating if the rotational velocity of the wheel exceeds that of the axle. The hub may be a direct drive or "fixed gear" hub that communicates torque between the axle and the wheel in both directions about the rotational axis of the wheel, axle, and hub. In some embodiments, the hub may be selectively movable from a freewheel behavior in an unlocked state to a direct drive behavior in a locked state to further enhance a user's experience and/or provide additional exercise options to a user.

In accordance with embodiments of the present disclosure, the hub may include a magnetic clutch. The magnetic clutch may include a rotor rotationally connected to the drivetrain, and specifically to the pedals. An armature may be rotationally connected to the wheel. When an electric current is passed through the field coil, the generated magnetic field may cause the armature to come into contact with the rotor, thereby rotationally fixing the wheel to the pedals, or placing the drivetrain in a fixed gear mode.

The unlocked state may transmit an input torque from the drivetrain to a wheel in a first rotational direction and may transmit little or no torque in a second rotational direction. For example, the unlocked state may transmit substantially all of an input torque (less drivetrain losses and up to a tensile or other yield strength of the components) in the first rotational direction and less than 5% of an input torque in the second rotational direction. In another example, the unlocked state may transmit substantially all of an input torque in the first rotational direction and less than 3% of an input torque in the second rotational direction. In yet another example, the unlocked state may transmit substantially all of an input torque in the first rotational direction and less than 1% of an input torque in the second rotational direction. In at least some examples, the unlocked state may transmit less than 0.1% of an input torque in the second rotational direction.

The locked state may transmit substantially all of an input torque (less drivetrain losses and up to a tensile or other yield strength of the components) in the first rotational direction and in the second rotational direction. In some embodiments, the locked state may transmit greater than 95% of an input torque in the first rotational direction and in the second rotational direction. In other embodiments, the locked state may transmit greater than 97% of an input torque in the first rotational direction and in the second rotational direction. In yet other embodiments, the locked state may transmit greater than 99% of an input torque in the first rotational direction and in the second rotational direction.

In some embodiments, the locked state may transmit greater than 300 Newton-meters (N-m) of torque from the drivetrain to the wheel in the first rotational direction and second rotational direction without slipping of the drivetrain and wheel relative to one another. In other embodiments, the locked state may transmit greater than 400 N-m of torque from the drivetrain to the wheel in the first rotational direction and second rotational direction without slipping of the drivetrain and wheel relative to one another. In some embodiments, the locked state may transmit greater than 500 N-m of torque from the drivetrain to the wheel in the first rotational direction and second rotational direction without slipping of the drivetrain and wheel relative to one another.

In some embodiments in the unlocked state, it is possible for the pedals of the drivetrain to continue moving after input from a user has ceased. For example, the rotational inertia of the wheel may urge the pedals to continue rotating without further input from the user. For safety purposes, a brake may be positioned on or supported by the frame and configured to stop or slow the wheel or other part of the drivetrain.

In some embodiments, the brake may be a friction brake, such as a drag brake, a drum brake, caliper brake, a cantilever brake, or a disc brake, that may be actuated mechanically, hydraulically, pneumatically, electronically, by other means, or combinations thereof. In other embodiments, the brake may be a magnetic brake that slows and/or stops the movement of the wheel and/or drivetrain through the application of magnetic fields. In some examples, the brake may be manually forced in contact with the wheel by a user rotating a knob to move the brake. In other examples, the brake may be a disc brake with a caliper hydraulically actuated with a lever on the handlebars. In yet other examples, the brake may be actuated by the computing device in response to one or more sensors.

In some embodiments, the changing of the drivetrain from a freewheel (unidirectional) drivetrain to a direct-drive (bidirectional) drivetrain may be limited by a lockout device. For example, the drivetrain may be movable between the locked state and the unlocked state below a defined rotational velocity of the wheel. In some embodiments, the lockout device may prevent the movement between the locked state and the unlocked state when the wheel has a rotational velocity greater than revolutions per minute (RPM). In other embodiments, the lockout device may prevent the movement between the locked state and the unlocked state when the wheel has a rotational velocity greater than 30 RPM. In yet other embodiment, the lockout device may prevent the movement between the locked state and the unlocked state when the wheel has a rotational velocity greater than 10 RPM. In further embodiments, the lockout device may prevent the movement between the locked state and the unlocked state when the wheel has a rotational velocity greater than 0 RPM. In at least one embodiment, the lockout device may prevent the movement between the locked state and the unlocked state unless the brake is engaged with the wheel and/or drivetrain to prevent movement of the wheel and/or drivetrain.

In other embodiments, the lockout device and/or the safety brake may be in data communication with one or more sensors, such as a speed sensor, a torque sensor, a wattmeter, or other sensor to measure and monitor the user's inputs and movement of the drivetrain and/or wheel.

In some embodiments, an elliptical trainer may include a frame that supports a drivetrain connected to a wheel with a safety brake. The frame may support a display and/or computing device to present, track, log, store, or communicate information for a user. In some embodiments, the drivetrain may have inputs from the user including both handlebars and pedals. For example, the drive mechanism, such as the linkage of the illustrated embodiment, may receive force from the user through movement of the handlebars and/or the pedals. The pedals may cycle through an elliptical path, while the handlebars may oscillate in an arcuate path (arrows A and B), to drive the linkage. In other embodiments, the drivetrain may have stationary handlebars and the pedals may drive the linkage independently of the handlebars. The linkage may rotate an axle, and the rotation of the axle may be transmitted to the wheel by a hub.

The hub may be a freewheel hub that allows the wheel to continue rotating if the rotational velocity of the wheel exceeds that of the axle. The hub may be a direct drive hub that communicates torque between the axle and the wheel in both directions about the rotational axis of the wheel, axle, and hub. In some embodiments, the hub may be selectively movable from a freewheel behavior to a direct drive behavior to further enhance a user's experience and/or provide additional exercise options to a user. In accordance with embodiments of the present disclosure, the hub may transition between the freewheel mode and the fixed gear mode using a magnetic clutch.

In some embodiments, a bicycle may have a frame that supports a drivetrain configured to rotate a wheel and seat and/or handlebars to support a user. The drivetrain may include pedals to receive input force from a user and drive mechanism, such as a chain or belt, to transmit the force to an axle. A hub may transmit torque from the axle to the wheel to rotate the wheel about a rotational axis.

The hub may be a freewheel hub that allows the wheel to continue rotating if the rotational velocity of the wheel exceeds that of the axle. The hub may be a direct drive hub that communicates torque between the axle and the wheel in both directions about the rotational axis of the wheel, axle, and hub. In some embodiments, the hub may be selectively movable from a freewheel behavior to a direct drive behavior to further enhance a user's experience and/or provide additional exercise options to a user. In some embodiments, the hub may be movable between a locked position and an unlocked position by a controller positioned on the handlebars or other location accessible by the user during use of the bicycle. For example, the controller may be electrically connected to a magnetic clutch located at the hub. The user may toggle the controller to activate the magnetic clutch. When the magnetic clutch is activated, an armature may be drawn toward a rotor connected to the pedals, and thereby the wheel rotationally with respect to the pedals. When the user toggles the controller to deactivate the magnetic clutch, the hub may move back into a freewheel mode.

A pedaled drivetrain may be configured to rotate a wheel. A "pedaled drivetrain", as used herein, may include any linkage, mechanism, or system that receives an input force from a human in a cyclic pattern and transmits that force to rotate a wheel. For example, a pedaled drivetrain may include platform pedals, as are common on exercise bicycles and conventional bicycles for transportation. In other examples, a pedaled drivetrain may include "clipless pedals" that engage with a cleat on a user's shoe to allow more efficient power transfer to the drivetrain throughout the pedal stroke. In yet other examples, a pedaled drivetrain may include hand pedals or grips that allow a user to cycle the pedals of the drivetrain with their hands, for example, to strengthen or rehabilitate the user's upper body. In further examples, a drivetrain having hand pedals may allow a user with limited or no lower body control to operate a cycling system for exercise and/or transportation.

The drivetrain may include a drive mechanism that transmits the force from the pedals to the wheel. The chain may engage with a first gear rotatable by the pedals. The chain may also engage with a second gear on the axle to apply a torque to the axle around the rotational axis and rotate the axle. The axle transmits torque to the wheel through a hub. In some embodiments, the hub is a freewheel hub that transmits torque in the first rotational direction.

In some embodiments, the pedals may be stationary as the wheel rotates due to rotational inertia or due to contact with the ground while a bicycle is moving. In other examples, the pedals may be rotating in a second rotational direction, opposite the first rotational direction. The pedals may move the chain and axle in the second rotational direction, and the freewheel hub may transmit little or no torque to the wheel to disrupt the rotation of the wheel in the first rotational direction.

In the locked state, the drivetrain may transmit torque to the wheel in both the first rotational direction and in an opposing second rotational direction about the rotational axis. For example, in the locked state, the torque from rotation of the axle is directly transmitted to the wheel in either rotational direction.

For example, a user may apply a forward torque to the pedals, which is transmitted through the chain to the axle. The drivetrain rotationally locks the axle and wheel in the locked state. Movement of the wheel, conversely, may apply a torque to the axle through the hub, moving the pedals. For example, when the wheel is moving in the first rotational direction, the pedals also move. The user may apply a rearward torque through the pedals to decelerate the wheel (i.e., accelerate the wheel in the second rotational direction) without the need for other brakes on the wheel itself.

In some embodiments, the drivetrain may transition between the unlocked state and the locked state during movement of the drivetrain, and in other embodiments, the drivetrain may transition from the unlocked state to the locked state when the drivetrain is stationary. In yet other embodiments, a drivetrain may be configured to transition from the unlocked state to the locked state both during movement and while stationary. In at least one example, a drivetrain may transition between the unlocked state and the locked state while the axle of the drivetrain and the wheel are moving at an equivalent rotational velocity.

In some embodiments, a magnetic clutch may be used to transition a drivetrain of an exercise device between the locked and the unlocked state. In some embodiments, the magnetic clutch may lock the rotation of a flywheel to the rotation of a rotor. The rotor may be rotationally fixed to a pedal of an exercise device.

To lock the rotation of the flywheel to the rotor, an armature may be rotationally fixed to the flywheel. A field coil may generate a magnetic field that causes the armature to move axially along a rotational axis of the flywheel. The magnetic field may cause the armature to come into contact with the rotor. Friction between the armature and the rotor may cause the armature, and therefore the rotor, to become rotationally fixed to the rotor. In this manner, when the magnetic clutch is activated, the flywheel may be placed in the locked position.

In some embodiments, the magnetic clutch may include one or more resilient elements. The resilient elements may bias the armature toward the unlocked position. Put another way, the resilient elements may bias the armature toward the flywheel. When the magnetic clutch is not activated, the resilient elements may pull the armature toward the flywheel, causing the armature to be disconnected from the rotor. When the magnetic clutch is activated, the magnetic force pulling the armature toward the rotor may be greater than the biasing force from the resilient elements pulling the armature toward the flywheel.

In some embodiments, the magnetic clutch may be connected to a frame of an exercise device with a mounting element. The mounting element may connect the magnetic clutch to the frame of the exercise device.

In some embodiments, the magnetic clutch may be activated by a controller on the exercise device. In some embodiments, the controller may be a manual controller. For example, the controller may be a switch, a toggle, a button, or any other manual controller. In some embodiments, the controller may be an electric controller, such as an input on an operating system, an input on a console, or other electric input. In some embodiments, the controller may receive voice input from the user. For example, the controller may include a microphone and voice-recognition software. The controller may recognize one or more words, phrases, or sentences that indicate that the user desires to activate the magnetic clutch. When the user desires to change between locked and unlocked modes, the user may simply state "lock flywheel," "unlock flywheel," or other command words/phrases. The microphone may pick up the user's words, and the voice-recognition software may recognize the words as an instruction to activate or deactivate the magnetic clutch. Based on the identified instruction, the controller may then activate or deactivate the magnetic clutch. In some embodiments, the voice-recognition software may recognize predetermined phrases. In some embodiments, the voice-recognition software may recognize plain text speech and identify the instructions from the plain text speech.

In some embodiments, the controller may be physically wired to the magnetic clutch. In some embodiments, the controller may be wirelessly connected to the magnetic clutch. For example, the controller may be connected to the magnetic clutch using any type of wireless connection, such as Bluetooth, Wi-Fi, Zigbee, IR transmission, NFC, cellular network (e.g., 3G, 4G, 5G, or any other cellular network), any other wireless connection, and combinations thereof.

In some embodiments, the magnetic clutch may be activated by a remote signal. For example, the magnetic clutch may be connected to a remote computing device. The remote computing device may provide an activation instruction to the magnetic clutch. In some embodiments, the remote computing device may be wirelessly connected to the magnetic clutch using a wireless connection, as discussed herein. In some embodiments, the remote computing device may be connected to the magnetic clutch over the Internet.

In some embodiments, the activation or deactivation signal to the magnetic clutch may be a part of an exercise program. An exercise program may have many different exercise activities or motions for a user to perform. In some embodiments, an exercise program may include exercise activities that include the use of the flywheel in the locked or unlocked configuration. When an exercise program reaches an exercise activity that involves a change in the configuration of the flywheel, the exercise program may send an instruction to the magnetic clutch to change between the locked and the unlocked configuration.

In some embodiments, operating an exercise device in the locked configuration may cause the pedals to rotate for as long as the flywheel is rotating. In some situations, this may cause the pedals to strike the user, potentially causing an injury to the user. In some embodiments, the exercise device may detect when the user is performing an exercise activity. For example, the exercise device may include a sensor that may detect when the user is using the exercise device, such as a force sensor on the pedals, a weight sensor on the seat, an optical sensor, any other type of sensors, and combinations thereof.

In some embodiments, the exercise device may detect when the user is using the exercise device. The exercise device may activate or deactivate the magnetic clutch based on the status of the user using the exercise device. For example, while the user is using the exercise device (e.g., when the pedal sensor senses that the user is applying a force to the pedal), the magnetic clutch may be activated, placing the flywheel in the locked configuration. In some examples, when the user stops using the exercise device (e.g., when the pedal sensor senses that the user has stopped applying a force to the pedal), the magnetic clutch may be deactivated, placing the flywheel in the unlocked configuration (e.g., the freewheel mode). This may help to improve the safety of the exercise device by preventing or reducing the chance of the pedal striking the user when the user is no longer performing an exercise activity.

As discussed herein, embodiments of the present disclosure have been described with the field coil being located on the same side of the flywheel as the rotor, such that when the field coil produces a magnetic field, the armature is drawn toward the rotor. However, it should be understood that the field coil may be located inside the flywheel, or on an opposite side of the flywheel from the rotor. The biasing elements may bias the armature toward the rotor such that the armature is normally in contact with the rotor thereby placing the flywheel in the locked position. When the field coil generates a magnetic field, the armature may be moved away from the rotor and become disengaged from the rotor, thereby placing the flywheel in the unlocked position.

In some embodiments, the biasing element may be located between the flywheel and the armature. The biasing element may bias the armature toward the flywheel. As discussed herein, the armature may be rotationally fixed to the flywheel. In some embodiments, a rotor may be located next to the armature. A field coil may be inserted into a cavity in the rotor. When the field coil is activated, the armature may be pulled toward the field coil, which may place the armature in contact with the rotor.

In some embodiments, a central axle extends through the entirety of the magnetic clutch along the rotational axis. The central axle extends through the flywheel, the armature, the rotor, and the field coil. The central axle may be rotationally connected to the drive mechanism. For example, the central axle may be rotationally connected to the pedals such that when the pedals are rotated, the central axle is rotated.

In some embodiments, the flywheel may be connected to the central axle with a freewheel hub. The freewheel hub may transfer torque from the central axle to the flywheel in a first direction, while allowing the central axle to freely rotate without transferring torque in a second direction. In some embodiments, the rotor may be rotationally fixed to the central axle such that the central axle may transfer torque to the rotor in both the first direction and the second direction.

As discussed herein, the armature may be rotationally fixed to the flywheel. The magnetic field generated by the field coil may draw the armature in a first direction toward the field coil and/or the rotor. When the field coil is deactivated, then one or more biasing elements may bias or pull the armature in a second direction back toward the flywheel.

In some embodiments, the magnetic field may cause the armature to come into contact with the rotor. The armature may engage the rotor with a friction force. The friction force may be a function of the contact area of the contact between the armature and the rotor, the coefficient of friction, and the contact force of the armature against the rotor caused by the magnetic field. In some embodiments, the friction force may allow the rotor to apply a torque to the flywheel.

In some embodiments, the friction force may allow the user to apply a torque that is opposite the direction of rotation of the flywheel. For example, the user may desire to exercise different muscles by slowing down rotation of the flywheel using the pedals. With the magnetic clutch engaged, the friction force between the rotor and the flywheel may transfer the opposite torque to the flywheel. In some embodiments, the frictional connection between the armature and the rotor may transfer 300 N-m of torque without slipping (e.g., without any relative rotation between the armature (and the connected flywheel) and the rotor). In some embodiments, the frictional connection may transfer 400 N-m of torque without slipping. In some embodiments, the frictional connection may transfer 500 N-m of torque without slipping. In some embodiments, the frictional connection may transfer greater than 500 N-m of torque without slipping.

In some embodiments, the frictional force may be based on the materials of one or both of the armature and the rotor, particularly the interaction of the material of an armature contact surface and the material of a rotor contact surface. For example, the armature and the rotor may be formed from a metal, such as a steel alloy, an aluminum alloy, or any other metal. In some embodiments, the armature contact surface and/or the rotor contact surface may include a coating of a high-friction material. For example, the armature contact surface and/or the rotor contact surface may include a rubber coating. In some examples, the armature contact surface and/or the rotor contact surface may include a ceramic material, a semi-metallic material, a composite material, any other material, and combinations thereof. In some embodiments, the armature and/or the rotor may include an attached friction plate. The friction plate may be connected to the armature and/or the rotor and may be formed from a high friction material to increase the coefficient of friction between the armature and the rotor.

In some embodiments, the armature contact surface and/or the rotor contact surface may have a surface roughness that is configured to increase the frictional force between the armature and the rotor. For example, the armature contact surface and/or the rotor contact surface may include one or more bumps, protrusions, or other surface roughness features that interact with corresponding surface roughness features on the opposing surface that increase the frictional force between the armature and the rotor. In some embodiments, the armature contact surface and/or the rotor contact surface may include one or more interlocking elements, such as matching protrusions and indentations in opposing surface. The protrusions and indentations may have sloped surfaces to assist in placing the armature and the rotor in the locked position during activation of the magnetic clutch.

In some embodiments, the magnetic clutch may be engaged while the flywheel is stationary (e.g., when the flywheel is not rotating). In some embodiments, the magnetic clutch may be engaged while the flywheel is rotating. In some embodiments, the magnetic clutch may be engaged while both the flywheel and the rotor are rotating. In some embodiments, the magnetic clutch may be engaged when the flywheel is rotating and the rotor is stationary (e.g., when the rotor is not rotating).

In some embodiments, the magnetic clutch may only be engaged when the rotor is rotating at the same rotational rate as the flywheel. This may help prevent a sudden increase in rotational rate of the pedals, which may injure the user. In some embodiments, the magnetic clutch may include one or more sensors that may determine when the flywheel is rotating at the same rate as the flywheel. For example, the flywheel and the rotor may include an accelerometer that may determine their rotational rate. In some embodiments, the pedals may include a sensor to determine if the user is applying a force to rotate the pedals. If the user is applying a force to rotate the pedal, then the user is rotating the flywheel. When the user is rotating the flywheel, the central axle may be applying a torque to the flywheel. Because the rotor is rotationally connected to the central axle, then the rotor may be rotated at the same rate as the flywheel. In some embodiments, the freewheel hub may include a sensor to determine when the central axle is applying a torque to the flywheel. When the sensor determines that the central axle is applying a torque to the flywheel (such as when one of the ratcheting members of the freewheel hub has a force applied to it), then the rotor may be rotating at the same rate as the flywheel.

In some embodiments, the magnetic clutch may be disengaged at any time. for example, the magnetic clutch may be disengaged while the flywheel is rotating and/or while the rotor is rotating. This may help to improve the safety of the exercise device if the user stops using the exercise device while the flywheel is rotating by disengaging the rotor from the flywheel, thereby stopping the pedals from rotating with the flywheel.

When an electric current is applied to the field coil, the field coil may generate a magnetic field. In some embodiments, the rotor may be formed from a magnetically permeable material. The magnetic field may pass through the rotor and into the armature. As may be seen, the magnetic field may pass between the armature and the rotor multiple times. The magnetic field may magnetize the armature, thereby applying a magnetic force to the armature. The magnetic force may urge the armature in the first direction. This may cause the armature to come into contact with the rotor. As may be understood, the field coil and the armature may be cylindrical, and the magnetic force may be applied to the armature around its circumference. In some embodiments, the strength of the magnetic field and the magnitude of the magnetic force may be varied by changing a size of the field coil and/or the amount of electric current passed through the field coil.

In some embodiments, a method 768 of transmitting torque in a pedaled drivetrain may include operating a flywheel in a freewheel mode. In the freewheel mode, a first torque applied by a pedal in a first direction is transferred to the flywheel and a second torque applied by the pedal in in a second direction is not transferred to the flywheel. A magnetic switch may be engaged to move an armature into contact with a rotor. The armature may be rotationally fixed to the flywheel and the rotor may be rotationally fixed to the pedal. The method may include operating the flywheel in a fixed gear mode. In the fixed gear mode, the first torque and the second torque are transferred to the flywheel.

In some embodiments, the method may include activating the magnetic clutch with a controller on a handlebar of the exercise device. As discussed herein, activating the magnetic clutch may be based on an input from an exercise program. In some embodiments, activating the magnetic clutch may be based on an input from a sensor on the exercise device. In some embodiments, activating the magnetic clutch may be based on an input from a user.

Following are sections in accordance with embodiments of the present disclosure:

A1. A pedaled drivetrain, comprising:
- a drive mechanism;
- a flywheel having a rotational axis;
- a hub connecting the drive mechanism to the flywheel in a first rotational direction around the rotational axis;
- a magnetic clutch connected to the drive mechanism and the hub, the magnetic clutch moving the hub between a locked state and an unlocked state based on an application of an electric current.

A2. The exercise device of section A1, wherein the magnetic clutch includes:
- a rotor rotationally fixed to the drive mechanism;
- an armature rotationally fixed to the flywheel; and
- a field coil configured to generate a magnetic current based on the application of the electric current.

A3. The exercise device of section A2, wherein the armature is axially movable along the rotational axis based on the generated magnetic current.

A4. The exercise device of section A2 or A3, wherein the magnetic current causes the armature to come into contact with the rotor.

A5. The exercise device of any of sections A2-A4, wherein the magnetic clutch further includes a biasing element to bias the armature toward the flywheel.

B1. A cycling system, comprising:
- a frame;
- handlebars supported by the frame;
- a flywheel having a rotational axis connected to the frame; and
- a drivetrain supported by the frame, the drivetrain rotationally connected to the flywheel, the drivetrain including:
  - a freewheel hub rotationally connected to the flywheel in a first direction; and
  - a pedal connected to the freewheel hub, wherein a rotation of the pedal causes a rotation of the freewheel;
  - a magnetic clutch, including:
    - a field coil configured to produce a magnetic field upon application of an electric current;
    - a rotor rotationally fixed to the pedal; and
    - an armature rotationally fixed to the flywheel, wherein the armature is axially movable along the rotational axis between a locked position and an unlocked position based on a presence of the magnetic field, wherein, in the locked position, the armature is rotationally fixed to the rotor.

B2. The cycling system of section B1, wherein the rotor includes a friction plate at a contact between the armature and the rotor, wherein the friction plate is formed from a high friction material.

B3. The cycling system of section B1 or B2, wherein the magnetic field causes the armature to move toward the rotor.

B4. The cycling system of any of sections B1-B3, wherein the magnetic clutch further includes a biasing element that biases the armature toward the flywheel.

B5. The cycling system of any of sections B1-B4, wherein the rotor is magnetically permeable.

B6. The cycling system of any of sections B1-B5, wherein the rotor is located between the field coil and the armature.

B7. The cycling system of any of sections B1-B6, wherein a rotation of the flywheel produces power for the field coil.

B8. The cycling system of any of sections B1-B7, wherein the handlebars include an actuation mechanism configured to actuate the field coil.

B9. The cycling system of any of sections B1-B8, further comprising a sensor configured to sense a torque direction of a torque applied to the pedal.

C1. A method of transmitting torque in a pedaled drivetrain, comprising:
- operating a flywheel in a freewheel mode, wherein, in the freewheel mode, a first torque applied by a pedal in a first direction is transferred to the flywheel and a second torque applied by the pedal in a second direction is not transferred to the flywheel;
- engaging a magnetic clutch to move an armature rotationally fixed to the flywheel into contact with a rotor rotationally fixed to the pedal; and operating the flywheel in a fixed gear mode, wherein, in the fixed gear mode, the first torque is transferred to the flywheel and the second torque is transferred to the flywheel.

C2. The method of section C1, further comprising activating the magnetic clutch with a controller on a handlebar of an exercise device.

C3. The method of section C1 or C2, wherein activating the magnetic clutch is based on an input from an exercise program.

C4. The method of any of sections C1-C3, wherein activating the magnetic clutch is based on an input from a sensor on the exercise device.

C5. The method of section C4, wherein the sensor is located in the pedal.

C6. The method of any of sections C1-C5, wherein activating the magnetic clutch is based on an input from a user.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A pedal drivetrain, comprising:

a drive mechanism;

a flywheel having a rotational axis;

a hub connecting the drive mechanism to the flywheel in a first rotational direction around the rotational axis; and a magnetic clutch connected to the drive mechanism and the hub, the magnetic clutch moving the hub between a locked state and an unlocked state based on an application of an electric current, wherein, in the unlocked state, a first torque applied by a pedal in the first rotational direction is transferred to the flywheel and a second torque applied by the pedal in a second rotational direction is not transferred to the flywheel.

2. The pedaled drivetrain of claim 1, wherein the magnetic clutch includes:

a rotor rotationally fixed to the drive mechanism;

an armature rotationally fixed to the flywheel; and a field coil configured to generate a magnetic current based on the application of the electric current.

3. The pedaled drivetrain of claim 2, wherein the armature is axially movable along the rotational axis based on the generated magnetic current.

4. The pedaled drivetrain of claim 2, wherein the magnetic current causes the armature to come into contact with the rotor.

5. The pedaled drivetrain of claim 1, wherein the magnetic clutch biases the armature toward the flywheel.

6. The pedaled drivetrain of claim 1, further comprising a safety button that moves the magnetic clutch from the locked state to the unlocked state.

7. A cycling system, comprising:

a frame;

handlebars supported by the frame;

a flywheel having a rotational axis connected to the frame; and a drivetrain supported by the frame, the drivetrain rotationally connected to the flywheel, the drivetrain including:

a freewheel hub rotationally connected to the flywheel in a first direction;

a pedal connected to the freewheel hub, wherein a rotation of the pedal causes a rotation of the flywheel; and a magnetic clutch, including:

a field coil configured to generate a magnetic field upon application of an electric current;

a rotor rotationally fixed to the pedal; and an armature rotationally fixed to the flywheel, wherein the armature is movable along the rotational axis between a locked position and unlocked position based on the magnetic field, wherein, in the locked position, the armature is rotationally fixed to the rotor, and wherein, in the unlocked position, a first torque applied by the pedal in the first direction is transferred to the flywheel and a second torque applied by the pedal in a second direction is not transferred to the flywheel.

8. The cycling system of claim 7, wherein the rotor includes a friction plate at a contact between the armature and the rotor, wherein the friction plate is formed from a high friction material.

9. The cycling system of claim 7, wherein the magnetic field causes the armature to move toward the rotor.

10. The cycling system of claim 7, wherein the magnetic clutch biases the armature toward the flywheel.

11. The cycling system of claim 7, wherein the rotor is magnetically permeable.

12. The cycling system of claim 7, wherein the rotor is located between the field coil and the armature.

13. The cycling system of claim 7, wherein a rotation of the flywheel produces power for the field coil.

14. The cycling system of claim 7, wherein the handlebars are configured to actuate the field coil.

15. The cycling system of claim 7, further comprising a sensor configured to sense a torque direction of a torque applied to the pedal.

16. A method of transmitting torque in a pedaled drivetrain, comprising:

operating a flywheel in a freewheel mode, wherein, in the freewheel mode, a first torque applied by a pedal in a first direction is transferred to the flywheel and a second torque applied by the pedal in a second direction is not transferred to the flywheel;

engaging a magnetic clutch to move an armature rotationally fixed to the flywheel into contact with a rotor rotationally fixed to the pedal; and operating the flywheel in a fixed gear mode, wherein, in the fixed gear mode, the first torque is transferred to the flywheel and the second torque is transferred to the flywheel.

17. The method of claim 16, further comprising activating the magnetic clutch with a controller on a handlebar of an exercise device.

18. The method of claim 17, wherein activating the magnetic clutch is based on an input from an exercise program.

19. The method of claim 17, wherein activating the magnetic clutch is based on an input from a sensor on the exercise device.

20. The method of claim 19, wherein the sensor is located in the pedal.

* * * * *